US010813403B2

(12) United States Patent
Vanhoutin et al.

(10) Patent No.: US 10,813,403 B2
(45) Date of Patent: Oct. 27, 2020

(54) FOOTBALL HELMET HAVING EXCEPTIONAL IMPACT PERFORMANCE

(71) Applicant: Kranos IP Corporation, Litchfield, IL (US)

(72) Inventors: Louis Anthony Vanhoutin, Iuka, IL (US); Vincent R. Long, St. Peters, MO (US); Robert Erb, Plandome, NY (US); Richard Groff, III, Litchfield, IL (US)

(73) Assignee: Kranos IP Corporation, Litchfield, IL (US)

( * ) Notice: Subject to any disclaimer, the term of this patent is extended or adjusted under 35 U.S.C. 154(b) by 0 days.

(21) Appl. No.: 16/269,664

(22) Filed: Feb. 7, 2019

(65) Prior Publication Data

US 2019/0216159 A1 Jul. 18, 2019

Related U.S. Application Data

(60) Provisional application No. 62/754,582, filed on Nov. 1, 2018, provisional application No. 62/768,257, filed on Nov. 16, 2018.

(51) Int. Cl.
*A42B 3/12* (2006.01)
*A42B 3/20* (2006.01)
(Continued)

(52) U.S. Cl.
CPC ..... *A42B 3/127* (2013.01); *A42B 3/063* (2013.01); *A42B 3/128* (2013.01); *A42B 3/20* (2013.01)

(58) Field of Classification Search
CPC ..... A42B 3/064; A42B 3/121; A42B 3/046; A42B 3/125; A42B 3/127; A42B 3/06;
(Continued)

(56) References Cited

U.S. PATENT DOCUMENTS 1,244,559 A 10/1917 Stocks
1,522,952 A 1/1925 Goldsmith
(Continued)

FOREIGN PATENT DOCUMENTS

WO 9626654 A1 9/1996
WO 9733494 A1 9/1997

OTHER PUBLICATIONS https://helmet.beam.vt.edu/varsity-football-helmet-ratings.html; Virginia Tech Helmet ratings 2018, accessed May 28, 2019. (Year: 2018).*

(Continued)

*Primary Examiner* — Robert H Muromoto, Jr.
(74) *Attorney, Agent, or Firm* — Notaro, Michalos & Zaccaria P.C.

(57) ABSTRACT

A NOCSAE-certified football helmet having a plastic shell, internal padding attached to an inner surface of the shell, and a face guard attached to the shell, is configured and designed to have a Predictive Concussion Incidence below 1.90, or 0.75 plus or minus 0.25, or in the range of 0.50 to 1.90, as measured by the 2018 Adult Football STAR Methodology. The face guard is attached to the shell at a plurality of attachment points below a line constructed through the midpoint of the height of the helmet and has an upper portion which contacts the shell above the face opening, without being attached to the shell at that point. The internal padding includes a front pad attached within the shell above the face opening, defining a first zone of a first stiffness and, adjacent to and above the first zone, a second zone of a second stiffness lower than the first stiffness. The internal padding also includes helmet liners which are not inflatable, and which contain slow response microcellular polyurethane pads.

29 Claims, 21 Drawing Sheets

(51) Int. Cl.
*A42B 3/06* (2006.01)
*A42B 3/04* (2006.01)

(58) Field of Classification Search
CPC ..... A42B 3/063; A42B 3/065; A42B 3/10; A42B 3/0406; A42B 3/0433; A42B 3/124; A42B 3/128; A63B 71/10; A63B 2209/00; A63B 71/081; A63B 60/08; B32B 5/22; B32B 2307/558; B32B 3/30
See application file for complete search history.

(56) References Cited

U.S. PATENT DOCUMENTS 2,140,716 A 12/1938 Pryale
2,785,405 A 3/1957 Snyder
2,892,195 A 6/1959 Monetta
3,116,490 A 1/1964 Zbikowski
3,166,761 A 1/1965 Strohm
3,189,917 A 2/1965 Sims
3,186,004 A 6/1965 Carlini
3,197,784 A 8/1965 Carlisle
3,208,080 A 9/1965 Hirsch
3,283,336 A 11/1966 Critser
3,323,134 A 6/1967 Swyers
3,582,990 A 6/1971 Frieder
3,761,959 A 10/1973 Dunning
3,872,511 A 3/1975 Nicholas
3,882,547 A 5/1975 Morgan
3,897,598 A 8/1975 Bednarczuk
4,023,213 A 5/1977 Rovani
4,101,983 A 7/1978 Dera
4,134,155 A 1/1979 Robertson
4,223,409 A 9/1980 Lee
4,300,242 A 11/1981 Nava et al.
4,307,471 A 12/1981 Lovell
4,370,759 A 2/1983 Zide
4,404,690 A 9/1983 Farquharson
4,466,138 A 8/1984 Gessalin
4,558,470 A 12/1985 Mitchell et al.
4,665,569 A 5/1987 Santini
4,677,694 A 7/1987 Crow
4,937,888 A 7/1990 Straus
4,947,490 A 8/1990 Hayden
5,035,009 A 7/1991 Wingo et al.
D330,951 S 11/1992 Neustadt
5,271,103 A 12/1993 Darnell
5,309,576 A 5/1994 Broersma
5,544,367 A 8/1996 March, II
5,561,866 A 10/1996 Ross
5,661,854 A 9/1997 March, II
5,794,271 A 8/1998 Hastings
5,799,337 A 9/1998 Brown
5,940,889 A 8/1999 Shirai
5,946,734 A * 9/1999 Vogan ..... A42B 3/00 2/171
5,956,777 A 9/1999 Popovich
5,963,990 A 10/1999 White
6,138,284 A 10/2000 Arai
6,154,889 A 12/2000 Moore, III et al.
6,272,692 B1 8/2001 Abraham
6,282,724 B1 9/2001 Abraham et al.
6,360,376 B1 3/2002 Carrington
6,378,140 B1 4/2002 Abraham et al.
D459,032 S 6/2002 Gatellet
D465,067 S 8/2002 Ide
6,658,671 B1 12/2003 Von Holst et al.
6,934,971 B2 8/2005 Ide et al.
D512,534 S 12/2005 Maddux
7,089,602 B2 8/2006 Talluri
D528,705 S 9/2006 Ide
7,105,607 B2 * 9/2006 Chen ..... C08K 5/01 524/366
7,226,484 B2 * 6/2007 Chen ..... A01K 85/00 424/84
7,254,843 B2 8/2007 Talluri
7,328,462 B1 2/2008 Straus
7,743,640 B2 6/2010 Lamp et al.
7,802,320 B2 9/2010 Morgan
7,832,023 B2 11/2010 Crisco
7,849,524 B1 12/2010 Williamson et al.
8,069,498 B2 12/2011 Maddux et al.
8,146,178 B2 4/2012 Maddux
8,819,871 B2 9/2014 Maddux et al.
8,966,671 B2 3/2015 Rumbaugh
9,131,744 B2 9/2015 Erb et al.
9,289,024 B2 3/2016 Withnall et al.
D753,346 S 4/2016 Erb
9,398,783 B2 7/2016 Nimmons
9,498,014 B2 * 11/2016 Princip ..... A42B 3/064
9,554,484 B2 * 1/2017 Rogers ..... A61B 5/01
9,622,533 B2 4/2017 Warmouth
9,797,821 B2 * 10/2017 Duma ..... G01N 3/30
9,839,251 B2 * 12/2017 Pannikottu ..... A42B 3/064
10,130,303 B2 * 11/2018 Kozloski ..... A61B 5/6803
D836,253 S 12/2018 Erb et al.
10,258,100 B1 * 4/2019 Erb ..... A42B 3/124
10,285,466 B2 * 5/2019 Princip ..... A42B 3/064
2002/0174480 A1 11/2002 Lombard
2003/0140400 A1 7/2003 Ho
2004/0025231 A1 2/2004 Ide
2004/0146541 A1 * 7/2004 Chen ..... A01K 85/00 424/405
2004/0261157 A1 12/2004 Talluri
2005/0008669 A1 * 1/2005 Chen ..... A01K 85/00 424/401
2006/0242752 A1 11/2006 Talluri
2007/0000032 A1 1/2007 Morgan
2007/0157370 A1 7/2007 des Ouches
2007/0163158 A1 7/2007 Bentz
2008/0201813 A1 8/2008 Yang
2008/0250550 A1 10/2008 Bologna et al.
2009/0031479 A1 2/2009 Rush, III
2009/0106882 A1 4/2009 Nimmons et al.
2009/0162596 A1 * 6/2009 Rios ..... A43B 13/04 428/45
2009/0260133 A1 10/2009 Del Rosario
2010/0043126 A1 2/2010 Morel
2010/0180362 A1 7/2010 Glogowski et al.
2010/0299813 A1 12/2010 Morgan
2011/0047678 A1 3/2011 Barth et al.
2011/0209272 A1 9/2011 Drake
2011/0271428 A1 11/2011 Withnall et al.
2012/0011639 A1 1/2012 Beauchamp
2012/0017358 A1 1/2012 Princip et al.
2012/0066820 A1 3/2012 Fresco
2012/0151663 A1 6/2012 Rumbaugh
2012/0198604 A1 8/2012 Weber et al.
2012/0310126 A1 * 12/2012 Bureau ..... A61F 5/05833 602/6
2012/0317705 A1 12/2012 Lindsay
2013/0254978 A1 10/2013 McInnis
2014/0137965 A1 * 5/2014 Truitt ..... A41D 27/08 137/596
2014/0150169 A1 6/2014 Ide
2015/0033453 A1 * 2/2015 Pannikottu ..... A42B 3/064 2/413
2015/0047110 A1 2/2015 Chilson
2015/0257471 A1 9/2015 Warmouth
2016/0021964 A1 * 1/2016 Duma ..... G01N 3/30 73/12.04
2016/0157546 A1 6/2016 Princip
2016/0228758 A1 8/2016 Bologna
2017/0196291 A1 7/2017 Glover et al.
2017/0196292 A1 7/2017 Reinhall et al.
2017/0196294 A1 7/2017 Fischer et al.
2017/0291095 A1 10/2017 Erb
2017/0303622 A1 10/2017 Stone et al.
2018/0153245 A1 * 6/2018 Pannikottu ..... A42B 3/121
2018/0184745 A1 7/2018 Stone et al.
2018/0235304 A1 8/2018 Fischer et al.
2018/0343953 A1 12/2018 Erb et al.
2019/0086309 A1 * 3/2019 Brandt ..... G01N 3/307

(56) References Cited

U.S. PATENT DOCUMENTS

OTHER PUBLICATIONS

Schutt F7 football helmet review, EP. 350, I know football, published Aug. 16, 2017; screen shot atttached full video available at this URL. https://www.youtube.com/watch?v=_ilr6PfN3Oc&spfreload=5. (Year: 2017).*
National Football League, Laboratory Testing that Aims to Help NFL Players Make Informed Helmet Choices, Aug. 7, 2018.
National Football League, NFL and NFLPA Release 2018 Helmet Laboratory Testing Performance Results, Apr. 16, 2018.
National Football League, Using Biomechanical Research to Support Improvements in Helmet Technology, Oct. 5, 2017.
National Football League, Transcript: Media Availability with Dr. Allen Sills and Jeff Miller, Mar. 2, 2019.
NOCSAE, Frequenty Asked Questions (retrieved Mar. 25, 2019).
International Search Report for PCT/US2011/045071, dated Dec. 19, 2011.
Picture of helmet worn by Don Maynard in web page titled Legendary Insights: Don Maynard Part 1, 2014.
Picture of "Antique Football Helmet 1910's Era" in web page titled Vintage Football Helmets Antique Football Helmets.
Picture of Spalding No. 25 ear protector.
Rawlings catalog page showing Rawlings Improved Intercollegiate Helmet No. 4.
Picture of late 1910-1920's Dog-Ear Style Leather Football Helmet.
Picture of Horace Partridge Helmet.
Picture of Folsom Sporting Goods Helmet.
Picture of D&M Scholastic Helmet.
D&M Sports Goods Catalog, Fall & Winter 1926-27, pp. 8-9.
Antique Sports Uniforms & Equipment 1840-1940, pp. 110-111.
Virginia Tech Helmet Lab, Adult Football STAR Methodology, 2018.
Beckwith et al., Measuring Head Kinematics in Football: Correlation Between the Head Impact Telemetry System and Hybrid III Headform, Ann Biomed Eng. Jan. 2012 ; 40(1): 237-248.
Virginia Tech Helmet Lab, Varsity Football Helmet Ratings (2018).
Jacob Bogage, The future of football equipment? Measuring a hit's impact on the brain, not just the helmet, Washington Post, Jun. 2, 2017.
Jacob Bogage, There's a new 'safest' football helmet for sale. Now can anyone afford it?, Washington Post, Nov. 22, 2017.
Richard Lovegrove, Hard Hitting Research, Virginia Tech Magazine, Winter 2016-17, 30-35.
Schutt Sports, Web page for Schutt F7 LTD Helmet retrieved Jan. 29, 2019.
AP News Sire, Schutt Sports Reclaims #1 Spot in Virginia Tech STAR Football Helmet Rating System, Sep. 28, 2018.
NFL and NFLPA Release 2018 Helmet Laboratory Testing Performance Results, Apr. 16, 2018.
Bryan Gruley The Truth About the Safety Ratings That Sell Football Helmets, Bloomberg.com, Jan. 28, 2015.
Transcript of the YouTube video titled "Schutt F7 Football Helmet Review—Ep. 350" at https://www.youtube.com/watch?v=_ilr6PfN3Oc&spfreload=5 (date unknown).
Final Written Decision in IPR2016-01646 (dated Feb. 5, 2018).

* cited by examiner

FOOTBALL HELMET HAVING EXCEPTIONAL IMPACT PERFORMANCE

CROSS-REFERENCE TO RELATED APPLICATIONS

This application claims priority from U.S. Provisional Patent Application Ser. No. 62/754,582, filed Nov. 1, 2018, which is incorporated by reference in its entirety, including all appendices, for all purposes.

This application also claims priority from U.S. Provisional Patent Application Ser. No. 62/768,257, filed Nov. 16, 2018, which is incorporated by reference in its entirety, including all appendices, for all purposes.

BACKGROUND OF THE SUBJECT TECHNOLOGY

The subject technology concerns football helmets, which are worn to protect the head of a football player from impacts sustained during play. An impact incident upon a helmet will impart linear acceleration and rotational acceleration to the wearer's head. Both linear acceleration and rotational acceleration, and the combination of linear and rotational acceleration, can contribute to the risk of injury, including the risk of concussion.

In the United States, the National Operating Committee on Standards for Athletic Equipment ("NOCSAE") develops performance standards for protective equipment used in a variety of sports, including football helmets and faceguards. Generally, new football helmets and face guards must meet NOCSAE standards, and must be certified as such, to be marketable and usable in competitive football play in at least the collegiate varsity and professional levels. As used herein, "NOCSAE Standards" shall mean the effective NOCSAE standards applicable to football helmets and faceguards as amended.

Although NOCSAE sets performance and test standards for athletic equipment, NOCSAE itself does not certify or approve athletic equipment. At the present time, NOCSAE requires third-party certification of compliance with its standards by a neutral, independent body. Currently, Safety Equipment Institute (SEI) oversees the certification of athletic equipment to NOCSAE standards. Equipment including football helmets that is certified to meet NOCSAE standards may be labeled or stamped with the appropriate certification mark, such as "Meets NOCSAE Standards" or "SEI Certified" or the like. As used herein, "NOCSAE-certified" shall mean equipment that is certified to meet NOCSAE's requirements for football helmets or faceguards as applicable, and which may or may not bear a NOCSAE certification mark. NOCSAE-certified equipment is deemed to meet NOCSAE Standards, as those terms are used herein.

The NOSCAE standards and certifications are essentially "pass-fail" tests and do not quantify the efficacy of certified helmets, or comparatively rank certified helmets. While the risk of injury from impacts during football play cannot be eliminated, the structure of a football helmet and its components, and the mechanical properties of the materials used therein, have a significant effect on the efficacy of the helmet in protecting the wearer. NOCSAE-certified football helmets in use today at the varsity, collegiate, and professional levels of the sport exhibit a wide range of efficacy in protecting wearers from injury.

The Helmet Lab of the Virginia Polytechnic Institute and State University ("Virginia Tech"), College of Engineering, Department of Biomedical Engineering and Mechanics has conducted comparative testing and rating of helmets including football helmets since 2011 according to its published methodologies. The Helmet Lab's current (2018) methodology for collegiate varsity football helmets is described in the "Adult Football STAR Methodology" publication (hereinafter the "STAR Methodology" or "2018 STAR Methodology"), which is incorporated by reference herein for all purposes.

Applying the STAR Methodology to samples of a helmet yields a score, or "STAR Value," as described in that publication. "STAR" is an acronym for "Summation of Tests for the Analysis of Risk." The STAR score is related to predictive concussion incidence, or the probability of concussion of a player wearing the tested helmet during a season of collegiate football play (see the STAR Methodology publication for details). A lower STAR Value is better and represents a lower predictive concussion incidence according to the science underlying the methodology. The helmets tested by the Helmet Lab are, generally, commercially available during the season of the test, and are tested using the lightest standard facemask for each helmet and a large-size shell.

Helmet manufacturers strive to achieve the lowest possible STAR Values. The Helmet Lab rankings have become very important in the marketplace, "kind of like the J.D. Power for ranking helmets" according to one industry chief executive. This is the case although the methodology is not immune to criticism and cannot perfectly model the risk of injury for any individual player or situation due to the incalculable factors and variables at play, the helmet being only one such factor.

In 2018, the STAR test methodology was updated to evaluate both linear and rotational acceleration. Prior to this update, the methodology evaluated only linear acceleration. Old scores from pre-2018 methodologies used by the Virginia Tech Helmet Lab do not take into account rotational acceleration and are not comparable to the 2018 STAR Methodology and the resultant STAR Values.

As used herein as a defined term, the "Predictive Concussion Incidence" of a helmet shall mean the score resulting from the application of the 2018 STAR Methodology test to samples of the helmet, on the same or functionally equivalent apparatus (for example, using a linear impactor) as the 2018 Helmet Lab tests. The STAR Values resulting from the 2018 Helmet Lab tests are examples of Predictive Concussion Incidence.

It should be noted that the NFL and the NFL Players Association sponsors comparative football helmet testing by Biokinetics Inc. of Ottawa, Canada. The Biokinetics test does not use the STAR Methodology and the results are not comparable.

BRIEF SUMMARY OF THE SUBJECT TECHNOLOGY

According to the subject technology, a NOSCAE-certified football helmet comprises a plastic shell, internal padding attached to an inner surface of the shell, and a face guard attached to the shell, and has an exceptionally low Predictive Concussion Incidence. Preferably the helmet has a Predictive Concussion Incidence of less than 1.9; or in the range of 0.50 to 1.90; or 0.75 plus or minus 0.25, for example.

In a non-limiting example of the subject technology, the internal padding of the football helmet includes shock-absorbing pads of thermoplastic polyurethane (TPU) polymer material having shock-absorbing projections, the pads being attached to an inner surface of the shell, including a dual-stiffness front pad which defines a first zone of a first stiffness above the face opening in the brow region, and above the first zone, a second zone of a second stiffness higher than the first stiffness. The zones of different stiffness can be achieved in one front pad by using TPU materials having different durometers (higher durometers being stiffer) and/or by providing different TPU structures including different densities of projections (higher density being stiffer), and by providing or omitting stiffening ribs adjoining adjacent projections. Additionally, in this non-limiting example the face guard is attached to the shell at two attachment points on each side of the shell, all of the four attachment points being below a line constructed through the midpoint of the height of the helmet, and the face guard has an upper portion which contacts the shell (or the nose bumper attached to the shell) above the face opening, but is not attached to the shell at that point.

A range of different, exceptionally low Predictive Concussion Incidence values is possible according to the subject technology. Varying the properties of the front pad and other TPU padding, the location of the face guard attachments, the thickness and/or heaviness of the face guard, and the size and weight of the shell, for example, influence the resulting Predictive Concussion Incidence of the helmet.

The limitations of the claimed invention are pointed out with particularity in the claims annexed to and forming a part of this disclosure. Reference is made to the accompanying drawings and written description in which non-limiting embodiments of the subject technology are illustrated. It should be understood that the scope of the invention is limited only by the recitations of the claims, and not by any other choice of structure, materials, theory of operation, method of manufacture, or method of use unless specified in a given claim.

DETAILED DESCRIPTION OF THE SUBJECT TECHNOLOGY

Figure 1B:
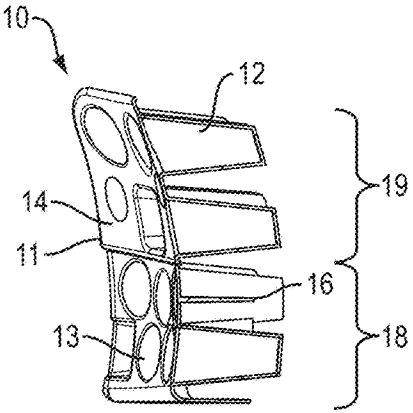
FIG. 1B is a cross-sectional view of the dual-stiffness, dual-durometer TPU front pad according to FIG. 1A along the line 1B-1B.
Figure 1D:
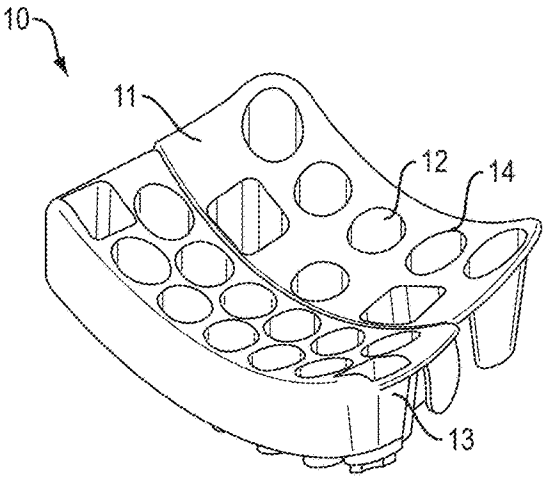
FIG. 1D is a perspective rendering of a dual-stiffness, dual-durometer TPU front pad according to a non-limiting aspect of the subject technology.
Figure 1A:
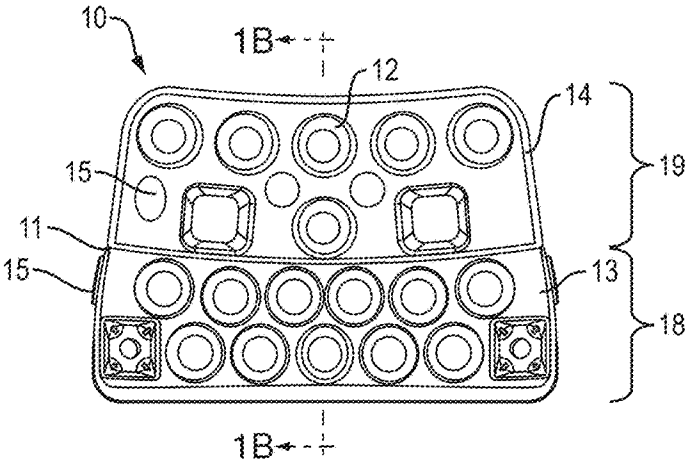
FIG. 1A is a rear view of a dual-stiffness, dual-durometer TPU front pad according to a non-limiting aspect of the subject technology.
Figure 1C:
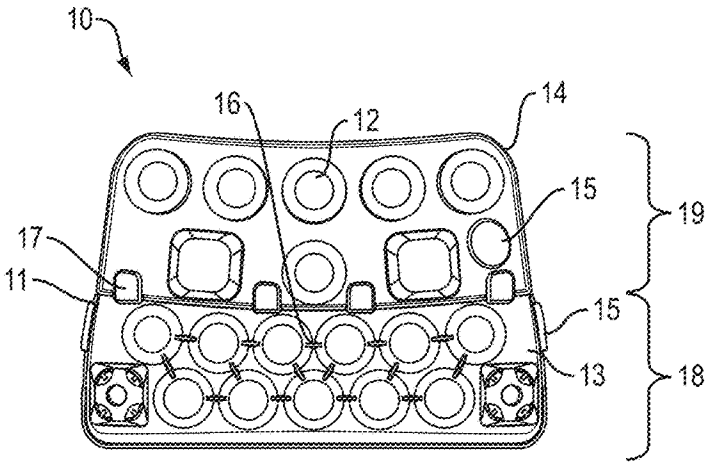
FIG. 1C is a front view of a dual-stiffness, dual-durometer TPU front pad according to a non-limiting aspect of the subject technology.
Figure 2B:
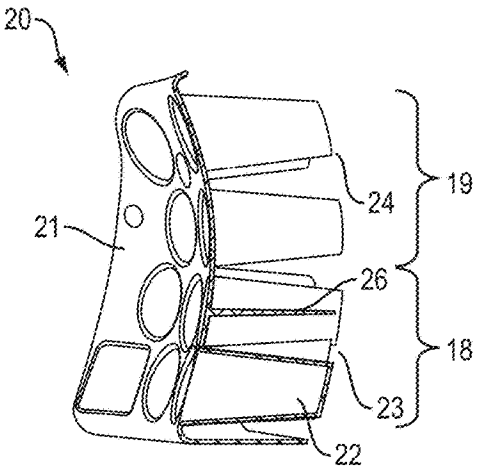
FIG. 2B is a cross-sectional view of the dual-stiffness, single-durometer TPU front pad according to FIG. 2A along the line 2B-2B.
Figure 2D:
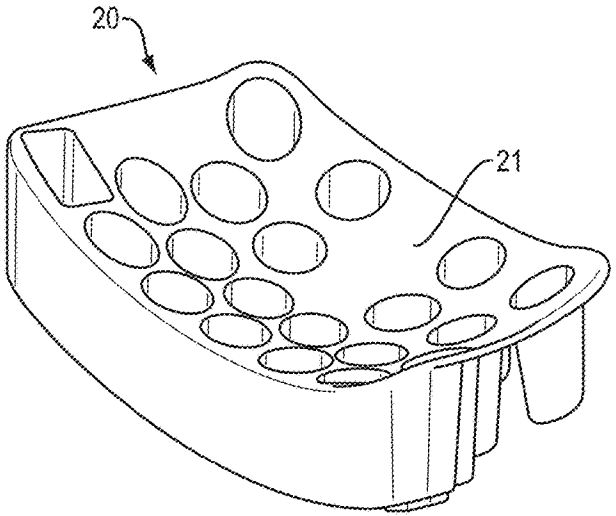
FIG. 2D is a perspective rendering of a dual-stiffness, single-durometer TPU front pad according to a non-limiting aspect of the subject technology.
Figure 2A:
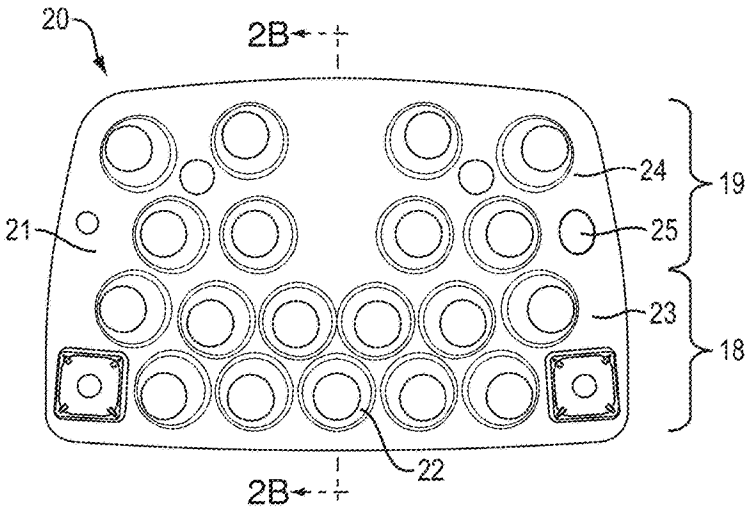
FIG. 2A is a rear view of a dual-stiffness, single-durometer TPU front pad according to a non-limiting aspect of the subject technology.
Figure 2C:
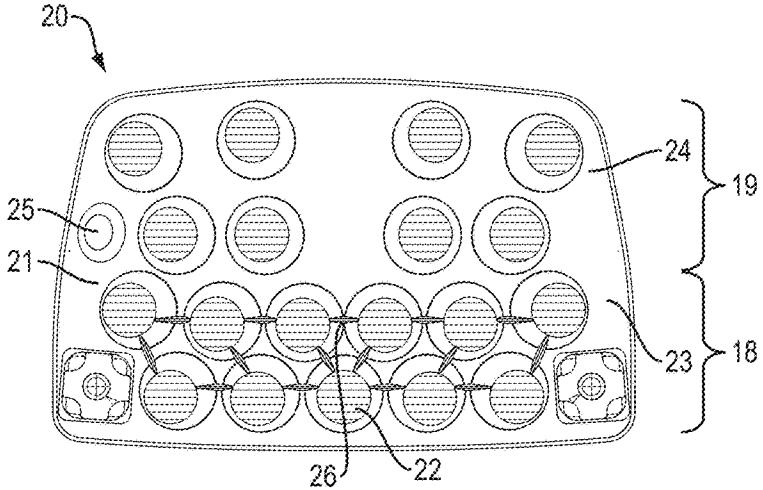
FIG. 2C is a front view of a dual-stiffness, single-durometer TPU front pad according to a non-limiting aspect of the subject technology.

The subject technology concerns football helmets having outstanding performance in laboratory tests of predictive concussion incidence.

Modern football helmets generally comprise a plastic shell, usually a one-piece shell made of ABS or polycarbonate plastic; internal padding inside the shell, attached directly or indirectly to the inner surface of the shell by, for example, T-nuts or hook-and-loop tape; and a face guard (i.e. a facemask) attached to the shell. It will be understood that various types of plastic and other rigid materials including composites incorporating INNEGRA®, KEVLAR®, fiberglass, and carbon fiber materials, may be used to make a football shell and are within the scope of the subject technology. A football helmet shell has a front region, a crown region, a rear region, a left side region, a right side region, an inner surface and an outer surface. Earflaps of the shell cover the left and right sides of the head and contain ear holes. Additional holes are formed in the shell for ventilation or for attachment of internal padding, chinstraps, face guards, and visors.

Many varieties and structures of internal padding are known in the art. Internal padding may include helmet liners, for example, foam elements encapsulated within cells formed between polymer (e.g. vinyl or TPU) layers, and some or all of the cells may be inflatable through a valve in the case of an "air liner." Internal padding may also include a comfort layer or layers inside the liners (i.e. between the liners and the wearer's head), comprising a soft material to improve fit and comfort. Internal padding structures and systems which may be used with the subject technology are disclosed, for example, in U.S. Pat. Nos. 8,069,498, 9,131,744, and 9,622,533, and co-pending U.S. patent application Ser. No. 15/855,876, all of which are owned by the assignee of the present application and are incorporated herein by reference for their technical teachings.

Internal padding of a football helmet may include shock-absorbing pads or padding made of formed, thermoformed or molded sheets of thermoplastic urethane (TPU) polymer material. Football helmets with internal padding comprising (among other elements) shock-absorbing pads or padding made of TPU are described, for example, in U.S. Pat. Nos. 8,069,498, 9,131,744, and 9,622,533, and co-pending U.S. patent application Ser. No. 15/855,876.

These TPU shock absorbers generally take the form of a sheet of TPU material having integrally formed, tapering projections (for example, domes, cones, pyramids, frustums of cones, pyramidal frustums or other tapering projections) extending from the sheet. The projections are spaced apart from each other and are distributed over an area of the TPU sheet. The projections are hollow and will collapse upon receiving a shock, thereby partially or completely absorbing and cushioning the shock, and will resiliently return to their initial shape after the impact event is over. The projections may be connected to neighboring projections by integrally formed ribs or bridges of the TPU material, to stiffen their response to impacts. Such TPU pads have been used in the rear, sides, crown, and front of helmets. TPU is a preferred polymer for the subject technology, however, alternative polymers could be used, provided that the polymer materials will resiliently return to their original shape.

Various TPU materials are commercially available from suppliers, for example Bayer MaterialScience, having various physical and chemical properties. TPU material is available in a variety of nominal durometers (i.e. material hardness). The durometer or hardness of TPU material is conventionally quantified in terms of the Shore "A" durometer scale.

Relevant to the subject technology, as applied to TPU shock absorbing pads, a relatively harder TPU material (i.e. having a higher durometer on the Shore "A" scale) will be stiffer than a relatively softer TPU material and will respond more stiffly to impact shocks. That is, a softer TPU projection will collapse more readily than a harder TPU projection in response to a shock.

The stiffness of a TPU shock absorber and its projections may also be modified by providing (or omitting) ribs or bridges of TPU, which may be integrally formed with the projections and/or base sheet, and which join adjacent projections. Ribs or bridges between projections buttresses the projections so that they respond more stiffly to shocks than projections which stand alone.

In addition to using different durometers and/or connecting ribs, the stiffness of a section of a TPU shock absorber may also be modified by selecting the density of projections. The more densely the projections populate a given area of the shock absorber, the more stiffly the shock absorber will react to shock applied to that area.

The subject technology is especially applicable to impact upon the front of a football helmet, which may land directly on the front region of the helmet shell or on the face guard which is connected to the shell. In football, impacts may come from any direction and land on any part of a helmet, however, the front of the shell is frequently impacted during play, for example, at the line of scrimmage or during blocking and tackling. The applicants have discovered that it is very advantageous, in a TPU shock absorbing pad for the front of the helmet (i.e., a TPU pad installed above the face opening, about the area of the wearer's brow and/or forehead), to configure the pad so that it defines two adjacent zones of different stiffness (i.e., is a "dual-stiffness" pad); particularly a first zone of relatively high stiffness above and adjacent to the helmet face opening, and generally overlying all or part of the wearer's brow; and, adjacent to and above the first zone, a second zone of relatively lower stiffness (relative to the first zone) generally overlying the wearer's upper forehead. Preferably the two adjacent zones of different stiffness are side-by-side and do not overlap. The front pad is installed in the helmet shell, connected to the inner surface of the helmet shell directly or indirectly by, for example, T-nuts or hook-and-loop fasteners, at a location in the front region of the shell just above and adjacent to the face opening. The front pad overall is curved so that the peaks of the projections conform to the concave inner surface of the helmet, and the base sheet is curved to allow for the convex curvature of the wearer's head. The subject technology is not limited to pads of two different stiffnesses, and can be applied to pads with three or more different stiffnesses in three or more zones.

To describe this aspect of the subject technology another way: a front shock-absorbing dual-stiffness pad is comprised of a sheet of TPU with integrally formed, tapering projections, in two sections. The first section is just above the face opening and is positioned generally over the brow area of the wearer, and the second section is above the first section (i.e, is attached (or is formed) at or near the top edge of the first section) and positioned generally over the higher-forehead area of the wearer. The first section may be positioned adjacent to, and may partially overlie, the area of the inferior border of the frontal bone of the skull just above the supraorbital ridge, while the second section may be positioned higher, partially overlying the area of the frontal bone. Each section has a width (in the direction left-to-right as installed in the helmet) and a height. Typically, the width of each section is greater than the height, so that each section constitutes a horizontal band. The first section is configured to have a higher stiffness than the second section by an appropriate selection of TPU material durometer and structure (i.e. the shape of projections, density of projections, and presence or absence of buttressing ribs between projections) in each respective section. The height of the first section may be 1 inch, or approximately 1 inch, or 1.5 inches, or approximately 1.5 inches, or 2 inches, or approximately 2 inches, or in the range of 1 inch to 1.5 inches, or in the range of 1 to 2 inches, above the brow.

In a non-limiting embodiment of this aspect of the subject technology, a single-layer, dual-stiffness, dual-durometer TPU pad for inclusion in a football helmet has two or more adjacent sections made of differing TPU material having differing durometers, resulting in sections of differing stiffness, i.e. the projections in the different sections have different stiffness, at least partially due to the fact that they are made from TPU materials of different hardness. For example, a TPU pad may have a first section made of TPU material having a first durometer and a second section adjacent to the first section made of TPU material having a second durometer that is not equal to the first durometer.

Such a TPU pad may be manufactured, for example, by separately manufacturing the two sections as separate parts by, for example, thermoforming, injection molding, or blow molding using two different TPU materials having different durometers. The separate parts may then be joined by welding, adhering, clipping, snapping, interlocking or sealing one part to the other, edge-to-edge or slightly overlapping, so that they constitute a single pad. A separate part may be formed with tabs extending from an edge or perimeter of the part so that the tabs may be sealed to the other part and thereby comprise a single shock absorbing pad. Alternatively, the separate parts may be joined by attaching them both, side-by-side, to a third, backing, sheet of polymer material.

Figure 21:
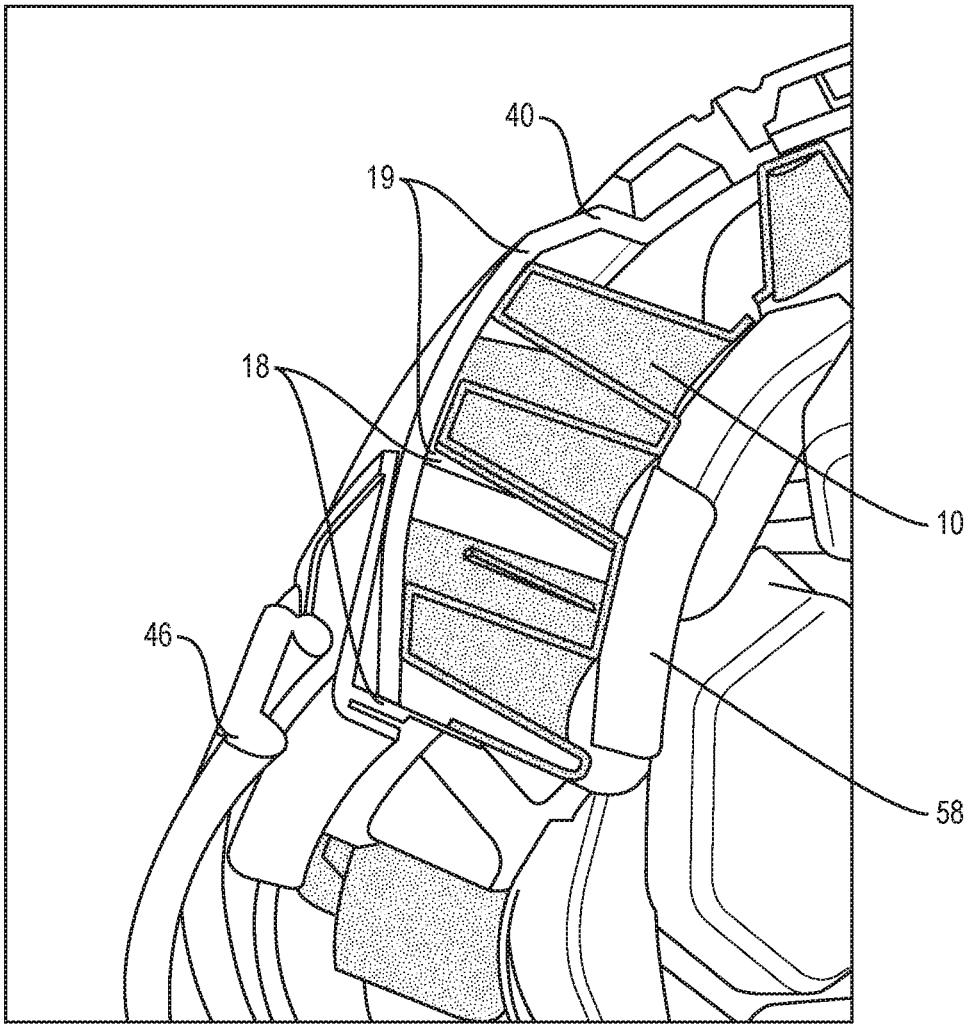
FIG. 21 is a sectional view along the Z-plane of a football helmet according to a non-limiting aspect of the subject technology, in the area of the top of the face opening of the shell, showing the relationship between the shell, the front pad, the zones of stiffness defined by the front pad, and the top of the face guard.

In this preferred but non-limiting embodiment, the projections of the single TPU pad having different durometers are in the same general orientation, e.g. they are all oriented from the base sheet or sheets toward the inner surface of the shell as opposed to being oriented in opposite directions (i.e. toward the shell and away from the shell). "Orientation" is intended to mean the general direction of a TPU cone or tapered projection from the base sheet toward the tip of the cone or tapered projection. In this orientation, the base sheet is separated from the inner surface of the shell by the projections of both adjacent sections. This feature is best seen in FIG. 21.

It should be appreciated that the single-layer, dual-stiffness, dual-durometer TPU pad of this embodiment comprises a single integral base sheet, or a single base sheet composed of two base sheets joined at or near their respective edges to form essentially a single base sheet, the single TPU pad having a first region of TPU projections extending from the base sheet having a first durometer, and a second region, adjacent to the first region, of TPU projections extending in the same orientation as the first region but having a different durometer and therefore a different hardness and stiffness.

In a preferred, non-limiting embodiment of the subject technology, as illustrated in FIGS. 1A-1D, a front pad 10 for a football helmet is composed of TPU material in the form of a sheet 11 of TPU material with hollow frusto-conical projections 12 (only one is numbered) extending therefrom, spaced apart from each other, and distributed over an area of TPU sheet 11. The embodiment of FIGS. 1A-1D has a first section 13 having first durometer and an adjacent second section 14 having a second durometer. With reference to the orientation of front pad 10 when installed inside the helmet, the tapering projections 12 extend from the base sheet 11 in the direction of the inner surface of the helmet.

In a preferred, non-limiting embodiment, the first durometer is higher than the second durometer. That is, the TPU material of first section 13 (i.e., the brow section), which is positioned immediately over the face opening and generally overlying all or part of the wearer's brow, is harder (and therefore stiffer) than the TPU material of second section 14 (i.e., the forehead section), which is attached (or is formed) at or near the top edge of first section 13 and positioned generally over the higher forehead area of the wearer. It should be understood from the foregoing description and FIGS. 1A-1D that the TPU pad 10 of this embodiment defines two adjacent zones 18, 19 of different stiffness; particularly a first zone 18 of relatively high stiffness generally overlying all or part of the wearer's brow, and, adjacent to and above first zone 18, a second zone 19 of relatively low stiffness generally overlying the wearer's upper forehead.

In a preferred, non-limiting embodiment, the first durometer is 90A, or approximately 90A, or 90A plus or minus 3; and the second durometer is 85A, or approximately 85A, or 85A plus or minus 3; provided that the first durometer is greater than the second durometer; all of the foregoing durometers on the Shore "A" scale.

In a second preferred, non-limiting embodiment, the first durometer is 95A, or approximately 95A, or 95A plus or minus 3; and the second durometer is 85A, or approximately 85A, or 85A plus or minus 3; provided that the first durometer is greater than the second durometer; all of the foregoing durometers on the Shore "A" scale.

In a third preferred, non-limiting embodiment, the first durometer is 85A, or approximately 85A, or 85A plus or minus 3; and the second durometer is 80A, or approximately 80A, or 80A plus or minus 3; provided that the first durometer is greater than the second durometer; all of the foregoing durometers on the Shore "A" scale.

In general, in a non-limiting embodiment the first durometer and second durometer are in the range of 80A-105A or in the range of 85A-105A, provided that the first durometer is greater than the second durometer.

In foregoing embodiments, the brow section 13 is formed of a harder TPU material and therefore is stiffer than the forehead section 14. More particularly, the projections of the first (brow) section 13 are formed of a harder TPU material than the projections of the second (forehead) section 14, and therefore the projections of the brow section 13 are stiffer than the projections of the forehead section 14.

Optionally, as shown in FIGS. 1A-1D the first and second sections 13, 14 include integrated areas 15 in the base sheet 11 that are thickened to enable proper measurement and verification of the durometer of the respective materials in those areas.

Additionally, in the non-limiting embodiment of FIGS. 1A-1D, the stiffness of the first section 13 and second section 14 may be further modified by providing (or omitting) ribs or bridges 16 (only one is numbered) which join and buttress adjacent projections 12. In the preferred, non-limiting embodiment of FIGS. 1A-1D, projections of the brow section 13 are joined by two, three, or four integrally formed ribs 16 to two, three, or four neighboring projections 12, as shown for example in FIG. 1C; while the projections 12 of the forehead section 14 are without ribs and stand alone, making them relatively more yielding (i.e. less stiff) when subjected to impact. In the preferred, non-limiting embodiment, the projections 12 of the first section 13 and the projections of the second section 14 all have the same orientation and extend from their respective TPU sheets toward the inner surface of the helmet.

In the embodiment of FIGS. 1A-1D, first section 13 and second section 14 are each manufactured separately by thermoforming each part from TPU material of the chosen durometer. First section 13 has tabs 17 (only one is numbered) on the margin, edge, or periphery of its base sheet, which is sealed to the base sheet of the second section 14 so that the sheets form essentially a single base sheet 11. Alternatively, second section 14 could have tabs for connecting to first section 13.

As an alternative to thermoforming, a polymer helmet pad having a plurality of sections of differing durometers may be formed by injection-molding, i.e., injecting hot, molten polymer material, for example TPU polymer, into an injection mold. The molten material then cools and solidifies in the mold, and the solid part is ejected from the mold. A dual-hardness pad according to an embodiment of the present technology may be manufactured by an injection-molding process in a single mold by injecting a molten first polymer that will have a first durometer when solidified to partially fill the mold, followed by injecting a molten second polymer that will have a second durometer when solidified (which may be higher or lower than the first durometer). Optionally, the injection of the second polymer may be followed by injection of a molten third polymer that will have a third durometer when solidified (which may be higher or lower than either the first or second durometers). After solidification and ejection from the mold, the pad will be an integral single-piece pad having a first region or section formed of the first polymer having a first durometer, and a second region or section formed of the second polymer having a second durometer. Optionally, the pad would have a third region or section formed of the third polymer having a third durometer. The subject technology is not limited to any method of manufacturing unless specified as a claim recitation.

In another, non-limiting embodiment of this aspect of the subject technology, FIGS. 2A-2D show a single-layer, dual-stiffness, single-durometer TPU front pad 20 having sections 23, 24 of different stiffness, which comprises a single, integral TPU pad of a single material (i.e., the entire pad is made of the same TPU material with the same durometer) comprising a base sheet 21 and projections 22 (only one is numbered). Sections of differing stiffness 23, 24 are achieved by providing connecting ribs 26 (only one is numbered) between some or all projections 22 in the stiffer section 23 while omitting the ribs from some or all projections in the softer section 24; or, the projections 22 are more densely populated in the stiffer section 23 than in the softer section 24; or both (as in the embodiment of FIGS. 2A-2D). In this manner, the single-durometer TPU of this non-limiting embodiment defines two adjacent zones 18, 19 of different stiffness; particularly a first zone 18 of relatively high stiffness generally overlying all or part of the wearer's brow, and, adjacent to and above first zone 18, a second zone 19 of relatively low stiffness generally overlying the wearer's upper forehead.

In non-limiting embodiments, the hardness of the TPU material of a single durometer pad may be 95A, or approximately 95A, or 95A plus or minus 3; or 53D, or approximately 53D, or 53D plus or minus 7. Other durometers of TPU could be used in this dual-stiffness, single-durometer front pad, for example, 90A, or approximately 90A, or 90A plus or minus 3; or 85A, or approximately 85A, or 85A plus or minus 3; or 85A, or approximately 80A, or 80A plus or minus 3; or in the range of 80A-105A or in the range of 85A-105A. Optionally, base sheet 21 has a thickened area 25 to enable proper measurement and verification of the durometer of material.

It is believed that the dual-stiffness TPU front pad of the subject technology (whether dual-durometer or single-durometer) improves football helmet performance during an impact at the front of the helmet or at the front boss of the helmet by stiffly resisting the initial shock of impact, but less-stiffly resisting the continuation of the impact after the initial shock. This results in less transmission of linear and rotational acceleration to the wearer's head, overall. This theory of operation does not limit the scope of the subject technology unless specified as a claim recitation.

The dual-stiffness TPU front pad of the subject technology, for example the embodiment of FIGS. 1A-1D or FIGS. 2A-2D, could be used in the football helmet of co-pending U.S. patent application Ser. No. 15/855,876 as a substitute for front pad assembly 153; or in the football helmet of U.S. Pat. No. 9,622,533 as a substitute for front pad 32; or in the football helmet of U.S. Pat. No. 9,131,744 as a substitute for front pad 32; or in the football helmet of U.S. Pat. No. 8,069,498 as a substitute for frontal pad 12. It may be used with any football helmet to improve its Predictive Concussion Incidence.

Figure 3A:
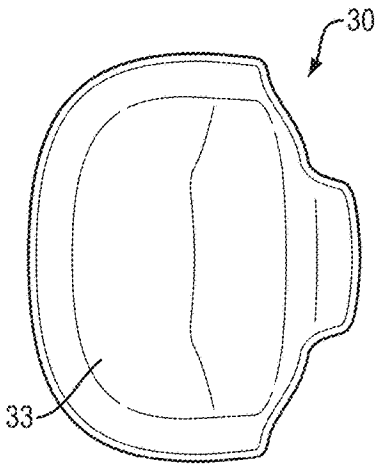
FIG. 3A is a view of a front pad liner according to a non-limiting aspect of the subject technology, turned inside-out to show the inner surface of the comfort pad.

As shown for example in the non-limiting embodiment of FIGS. 3A-3E, a dual-stiffness TPU front pad 31 of the subject technology, for example the embodiment of FIGS. 1A-1D or FIGS. 2A-2D, may be enclosed in a liner 30 consisting of a soft comfort pad 33 on the side of the pad facing the wearer, which may be soft EVA foam or "fit foam," and a fabric backing 32 made of a material such as nylon, tricot or cotton on the side facing the inner surface of shell, substantially as described in U.S. patent application Ser. No. 15/855,876 and FIGS. 38-39 of that application, for example. Preferably a pad 34 of Poron memory foam is inserted inside the liner 30 between the soft comfort pad and the dual-stiffness TPU front pad. FIG. 3A shows the liner turned inside-out for attachment of a fabric backing.

Figure 3B:
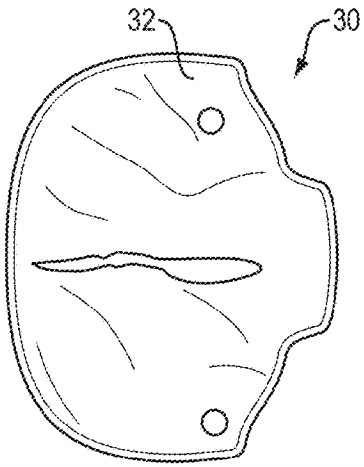
FIG. 3B is a view of a front pad liner according to a non-limiting aspect of the subject technology, turned right-side-out.
Figure 3C:
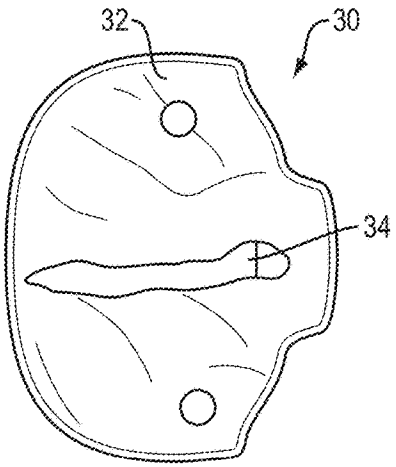
FIG. 3C is a view of a front pad liner according to a non-limiting aspect of the subject technology, with a Poron pad inserted into the liner.
Figure 3D:
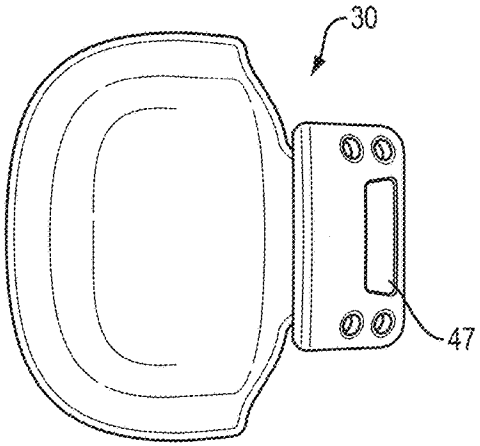
FIG. 3D is a view of a front pad liner according to a non-limiting aspect of the subject technology, with a nose bumper attached.
Figure 3E:
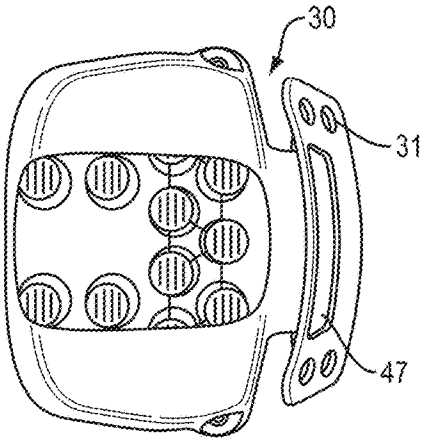
FIG. 3E is a view of a front pad liner according to a non-limiting aspect of the subject technology, with a nose bumper attached and TPU pad inserted.

FIG. 3B shows the same liner turned right-side out. FIG. 3C shows a Poron pad 34 inserted into the liner. FIG. 3D shows the other side of the liner (the side facing the wearer) with a nose bumper attached. FIG. 3E shows a dual-stiffness pad inserted into the liner. The completed liner would then be removable attached to the inner surface of the helmet shell, in the front above the face opening.

According to a further aspect of the subject technology, a face guard is attached to a football helmet shell at certain locations (i.e. attachment points) on the shell. Face guards for football helmets are typically in the form of a rigid cage of metal wires, for example, steel wires, carbon steel wires, or titanium wires, attached to the shell at attachment points. Several examples of face guards, means and hardware for attaching face guards, and attachment points are shown in U.S. Pat. Nos. 8,069,498, 9,131,744, and 9,622,533, and co-pending U.S. patent application Ser. No. 15/855,876, all of which are owned by the assignee of the present application and are incorporated herein by reference for their technical teachings.

The face guard attachment points are locations at which shocks, impacts, blows or other forces incident upon the face guard may be transmitted to the shell, and ultimately to the wearer's head. The face guard also acts as a mechanical brace to the shell which tends to stiffen the helmet and modify its response to shock forces during football play. It is advantageous to allow for some flexibility in the shell, and between the shell and face guard, to allow the flexure of the shell to modulate the forces applied during an impact shock. However, too much flexibility can result in exposure of part of the wearer's face during an impact, or other failure of the helmet to protect the wearer, which would be unsafe and would not comply with NOCSAE Standards.

Figure 4:
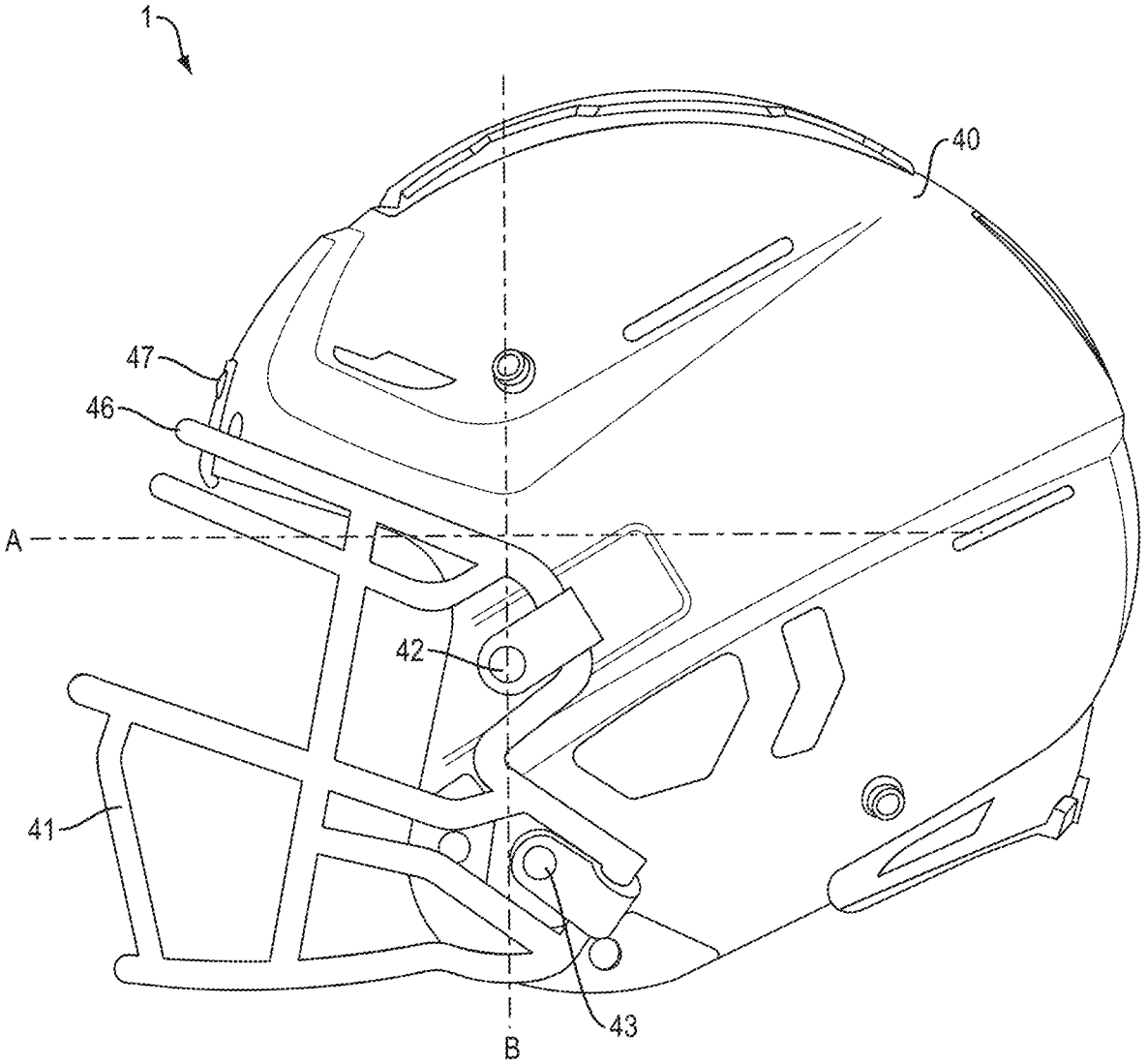
FIG. 4 is a left-side view of a football helmet according to a non-limiting aspect of the subject technology, showing especially the face guard and its attachment to the shell.

As shown for example in the non-limiting embodiments of FIGS. 4 and 5, the inventors have discovered that it is advantageous, and significantly improves performance of the helmet, to select attachment points below a line constructed through the midpoint, or approximately the midpoint, or 45%, or 40%, or 35%, of the height of the helmet as viewed from the right side or left side, the shell being oriented as shown in FIG. 4, substantially as shown for example in the non-limiting embodiments of FIGS. 4 and 5. In this aspect of the subject technology, preferably the face guard is not attached to the shell at any point above the line. This structure shall be referred to herein as a "below-the-line" face guard connection. Although in this embodiment the face guard is not attached to the shell "above-the-line," preferably the face guard has an upper portion that contacts the shell at a point or points above-the-line when at rest and/or when subjected to impacts. The upper portion of the face guard may contact the shell at or above the face opening, including at a nose bumper attached to the front of the shell at the center of the face opening. Preferably the upper portion of the face guard is not attached to the shell and is free to slide somewhat against the outer surface of the shell or the nose bumper when subjected to impacts.

Figure 5:
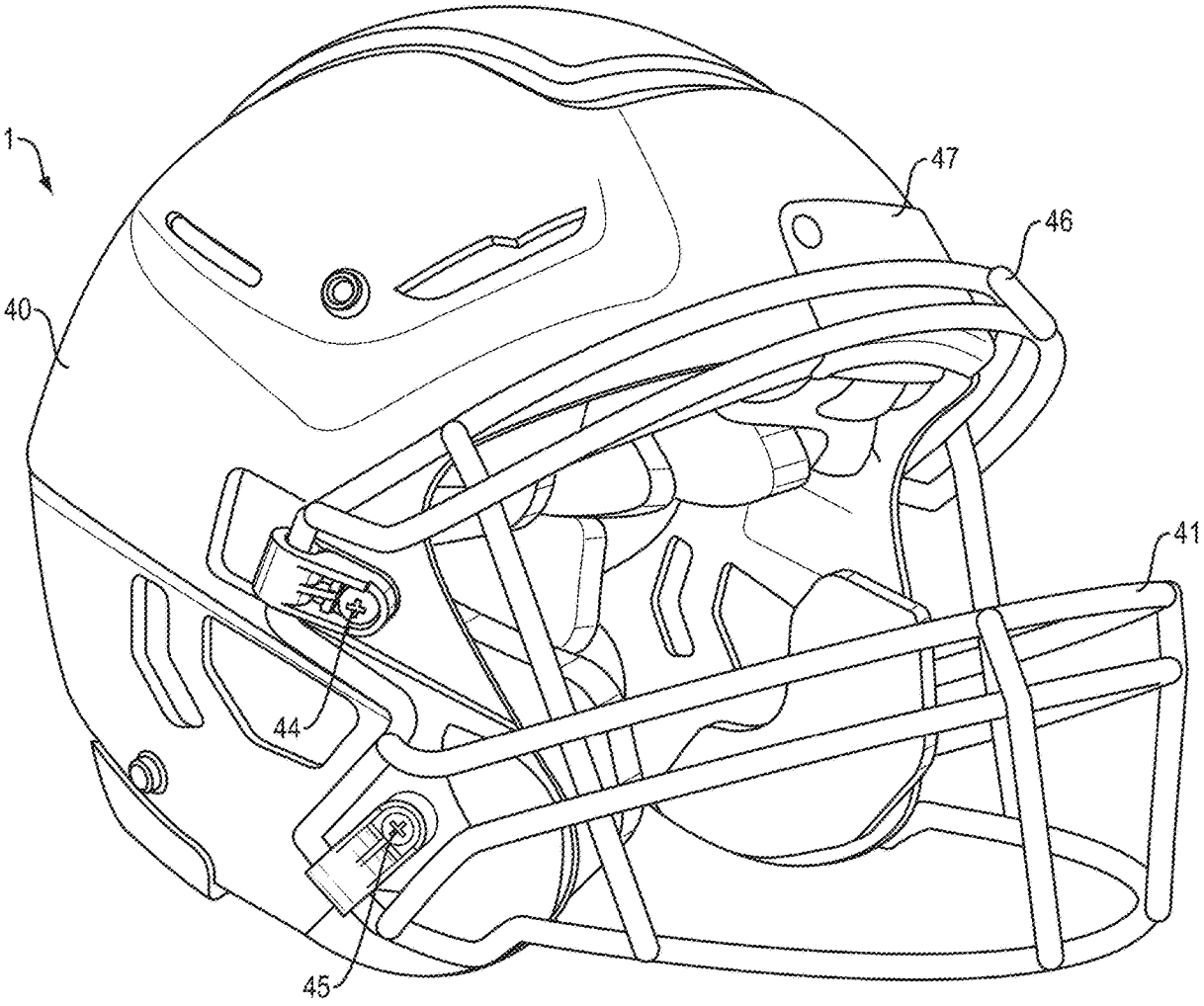
FIG. 5 is a perspective view of a football helmet according to a non-limiting aspect of the subject technology, showing especially the face guard and its attachment to the shell.

More specifically, in the non-limiting embodiments of FIGS. 4 and 5, a football helmet 1 has a plastic shell 40, and faceguard 41 is removably attached to shell 40 at four attachment points, 42-45. Two attachment points 42, 43 are on the left side of shell 40, two attachment points 44, 45 are on the right side. All four attachment points 42-45 are below a horizontal line A constructed through the midpoint, or approximately the midpoint, of the height of the helmet shell 40 along the vertical line B through the upper attachment point 42 or 44, the shell being oriented as shown in FIG. 4. With respect to the two attachment points on each side of the shell, the upper attachment point 42 or 44 is forward of the lower attachment point 43 or 45 respectively, the shell 40 being oriented as shown in FIG. 4. Also, the upper attachment point 42 or 44 is preferably higher than the lower attachment point 43 or 45 respectively by a distance of 20%-25%, preferably 23% or approximately 23%, of the height of the shell along the line B. Face guard 41 has an upper portion 46 which may touch the shell 40 or nose bumper 47 (if present), but is not attached to shell 40 or nose bumper 47 so it may slide or slip somewhat against or relative to the surface of shell 40 or nose bumper 47 when subjected to impacts.

In an alternative embodiment of this aspect of the subject technology (not shown in the Figures), the face guard may be additionally attached to the shell at one or more attachment points above the line A. Preferably, if the face guard is attached to the shell at one or more points above the line, those attachments are relatively soft and yielding compared to the below-the-line attachments, as for example, attachment via one or more relatively soft plastic loop straps or similar fasteners as known in the art, to reduce the transmission of impact force from the face guard to the shell at those points.

It should be understood that the below-the-line faceguard attachment of the subject technology may be used in conjunction with the dual-stiffness front pad 10 or 20 heretofore described, in the same helmet 1. However, the below-the-line faceguard attachment be used with any football helmet to improve its Predictive Concussion Incidence.

According to a further aspect of the subject technology, an inner liner for a football helmet comprises a top sheet of a suitable thin, flexible material such as TPU, vinyl, or the like, bonded to a bottom sheet of such material. Pockets are formed in the top sheet, which when bonded to the bottom sheet form cells which are distributed over the area of the top sheet facing the wearer, to provide comfort, fit and shock absorption. Some or all of the cells contain pads of slow-response foam (i.e. "memory foam"). Preferably, the slow-response foam is microcellular polyurethane, PORON®, OMALON®, or D30® foam. PORON® is a product of Rogers Corporation of Rogers, Conn.; OMALON® is a product of Carpenter Co. of Richmond, Va.; D30® is a product of D30® Lab, Croydon, UK. Ordinary polymer foam, e.g. "fit foam" may also be used in cells in a liner of this nature. The cells may be connected by passages and a valve admitted to one of the cells for inflation with an air pump, to form what is known in the art as an "air liner," for example, as shown in in U.S. Pat. Nos. 8,069,498, 9,131,744, and 9,622,533, or co-pending U.S. patent application Ser. No. 15/855,876. Alternatively, the liner may have no valve or other provision for introducing air, and/or no air passages between cells. In this alternative, the padding is provided solely by the included foam pads in the cells.

Figure 6B:
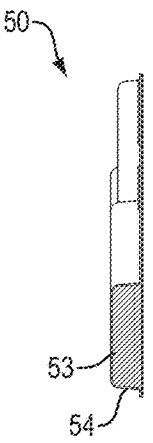
FIG. 6B is a cross-sectional view of a helmet liner according to FIG. 6A along the line 6B-6B.
Figure 6A:
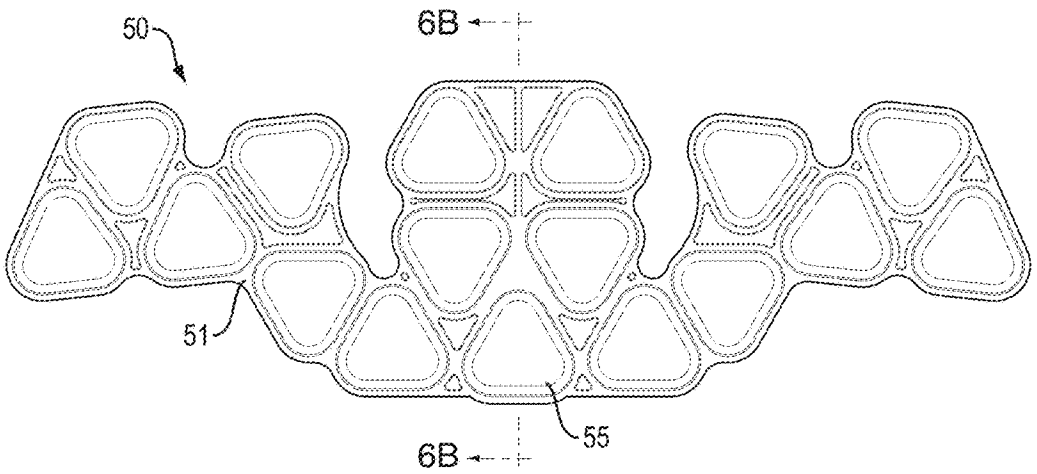
FIG. 6A is a top view (of the side facing the wearer) of a helmet liner according to a non-limiting aspect of the subject technology.
Figure 6C:
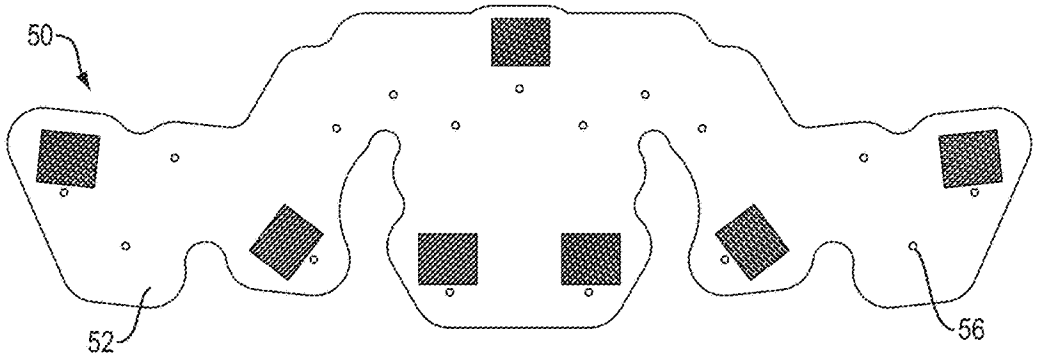
FIG. 6C is a bottom view of a helmet liner according to a non-limiting aspect of the subject technology.
Figure 7:
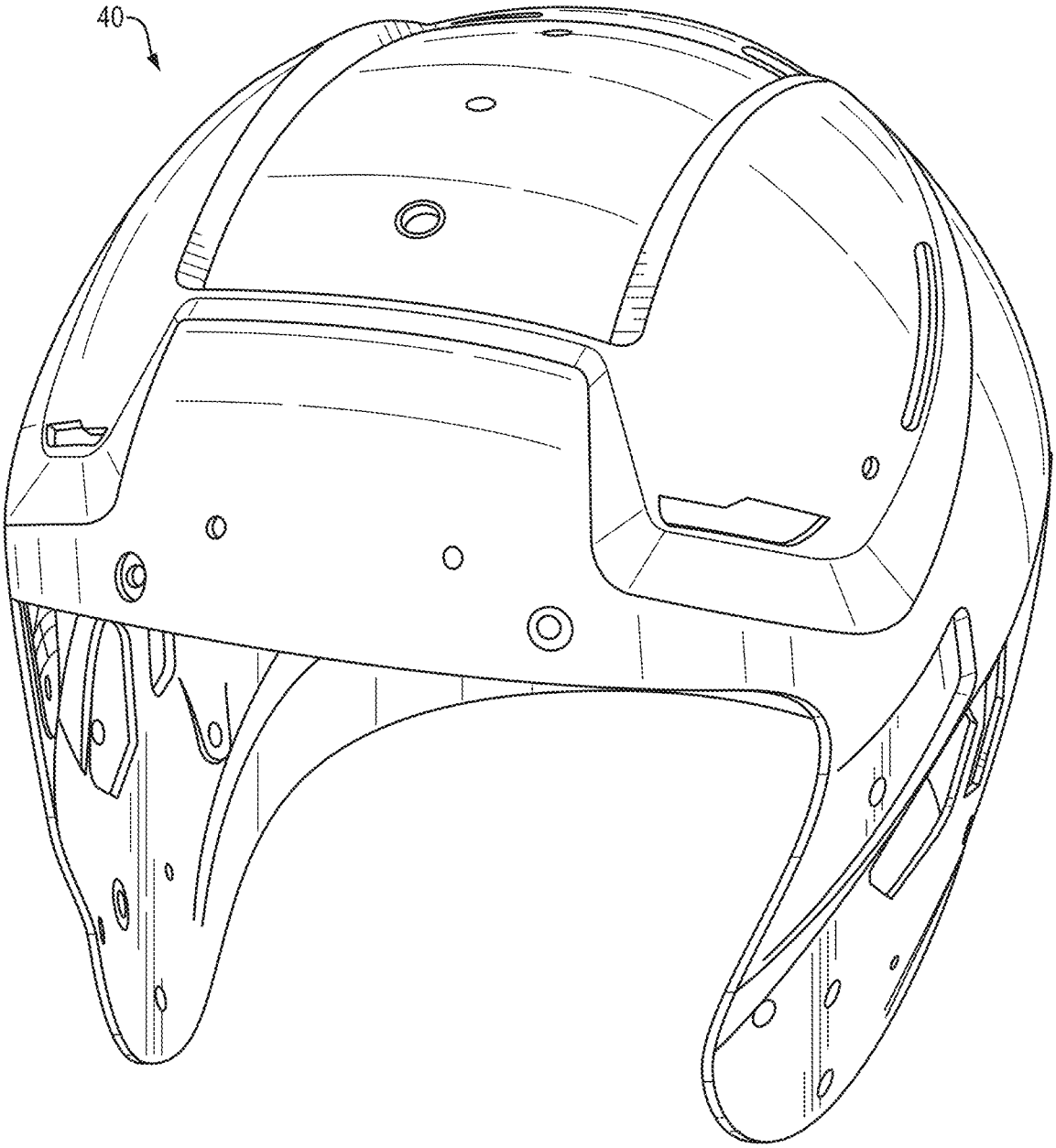
FIG. 7 is a perspective view of a football helmet shell according to a non-limiting aspect of the subject technology.
Figure 8:
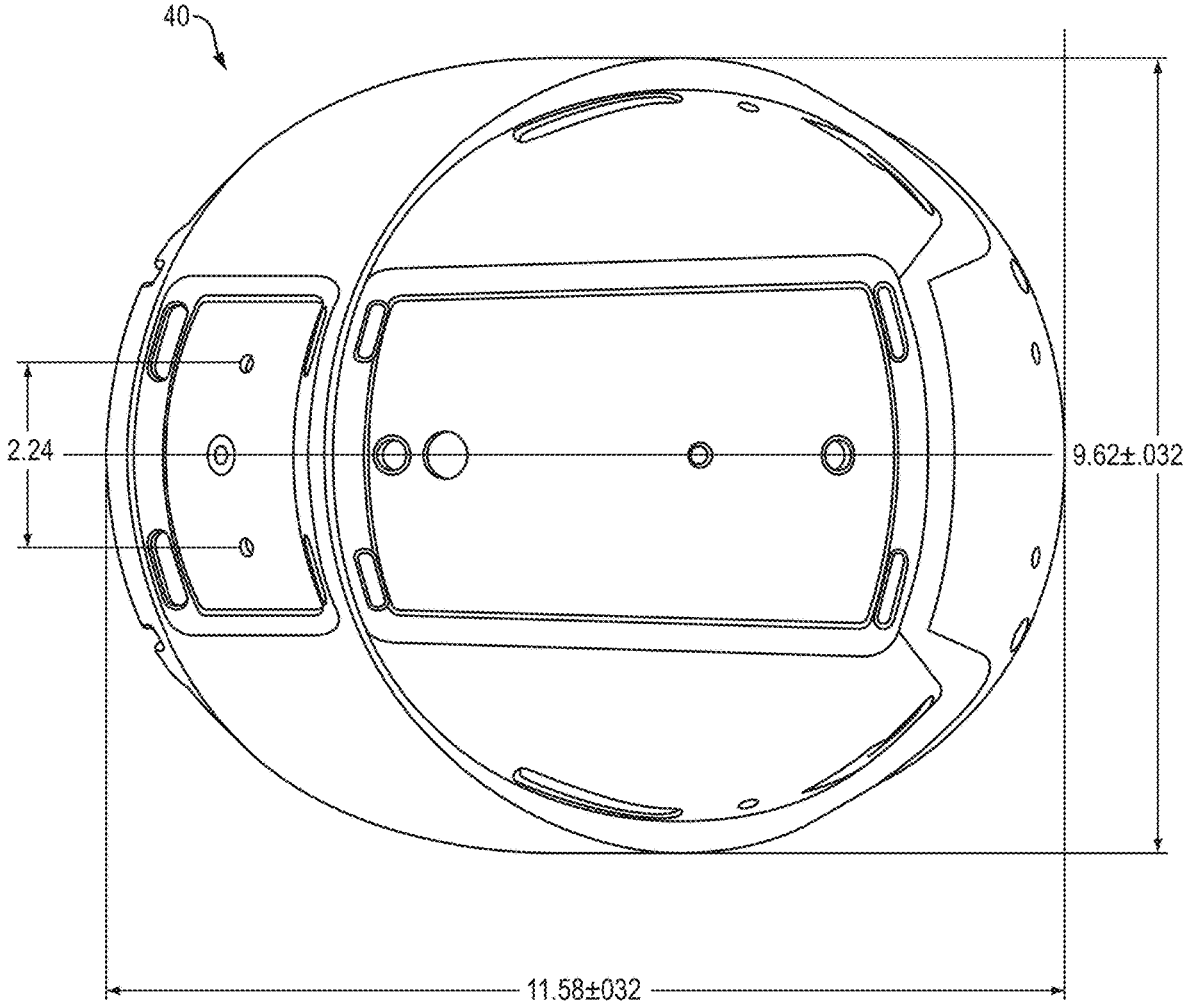
FIG. 8 is a dimensioned top view of a football helmet shell according to a non-limiting aspect of the subject technology. Dimensions in inches.
Figure 9:
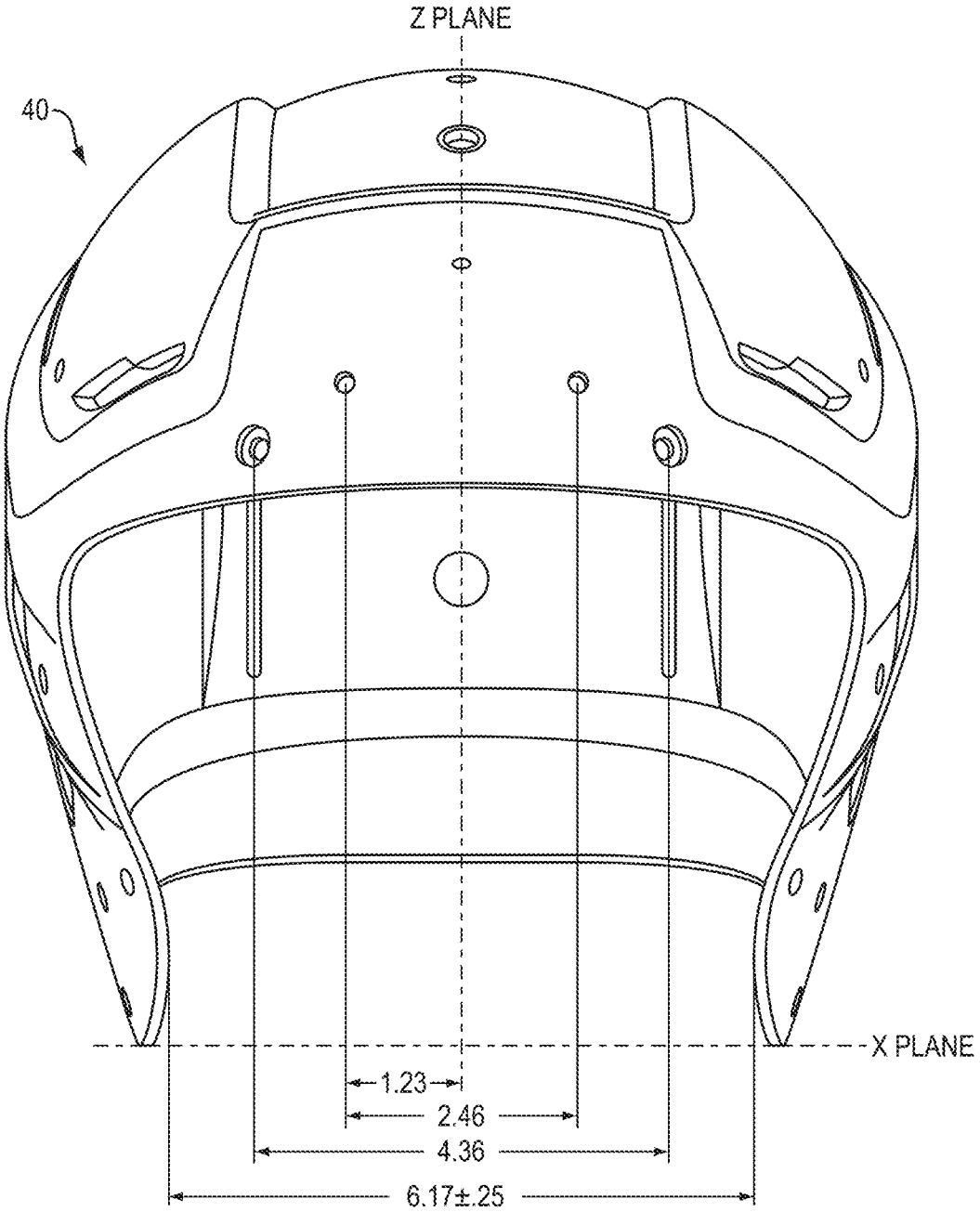
FIG. 9 is a dimensioned front view of a football helmet shell according to a non-limiting aspect of the subject technology. Dimensions in inches.
Figure 10:
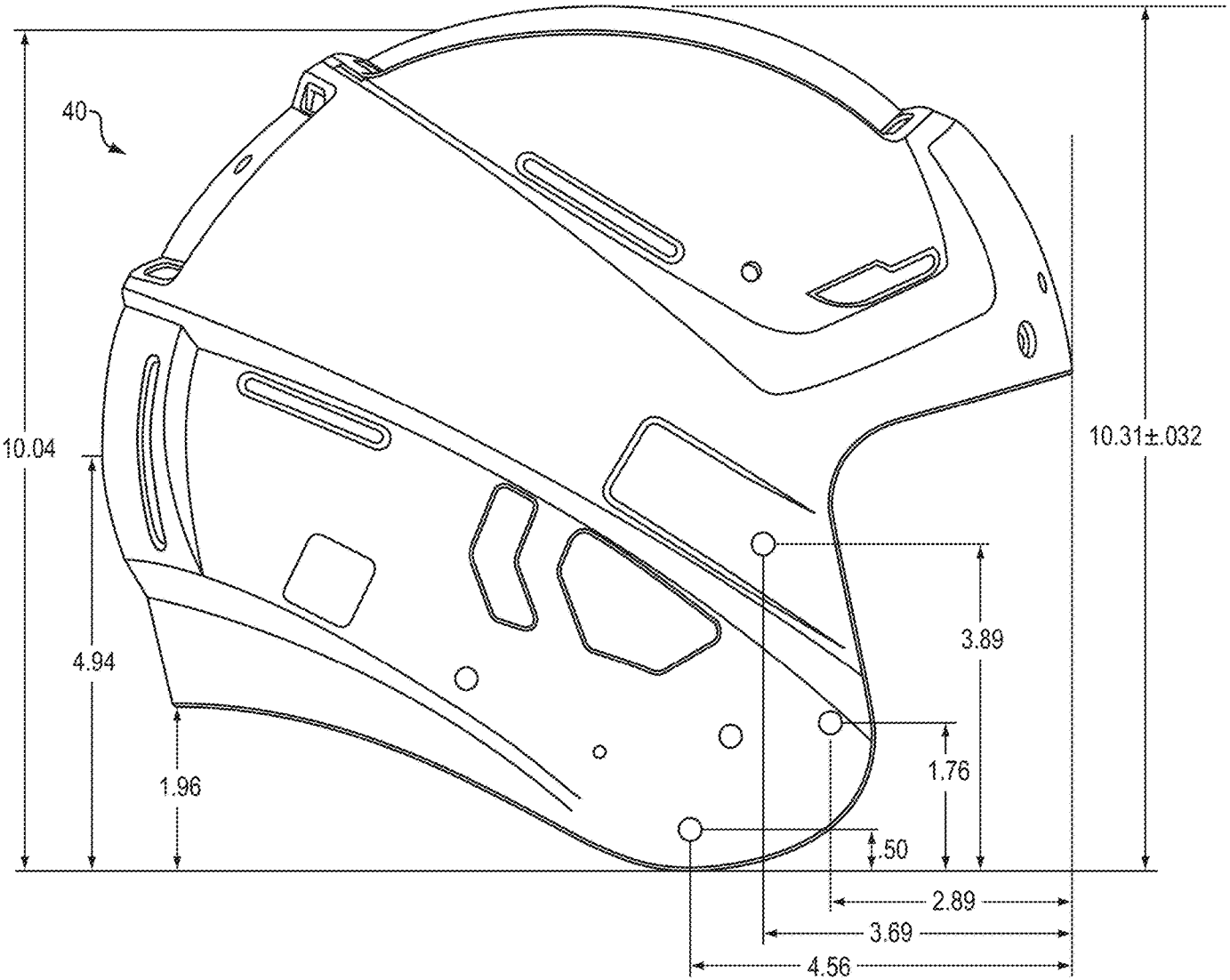
FIG. 10 is a dimensioned right-side view of a football helmet shell according to a non-limiting aspect of the subject technology. Dimensions in inches.
Figure 16B:
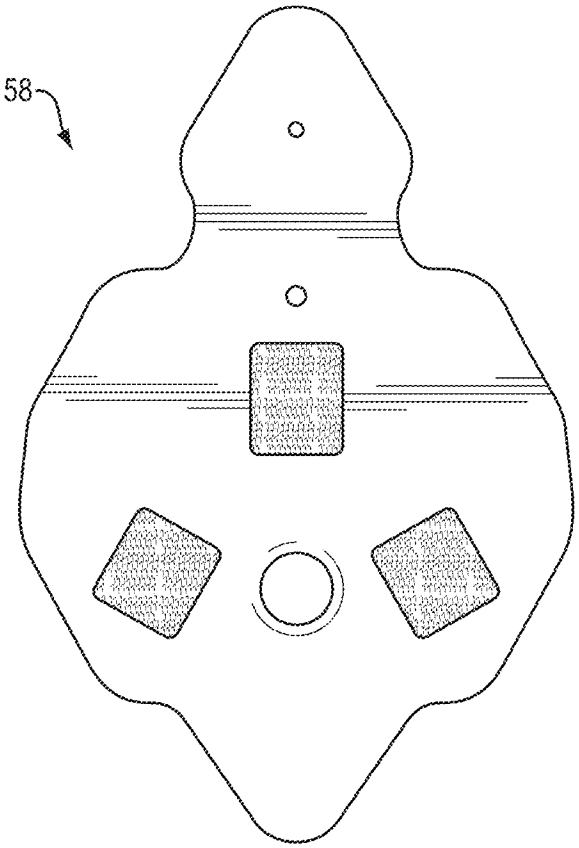
FIG. 16B is a bottom view of a helmet crown liner according to a non-limiting aspect of the subject technology.
Figure 16A:
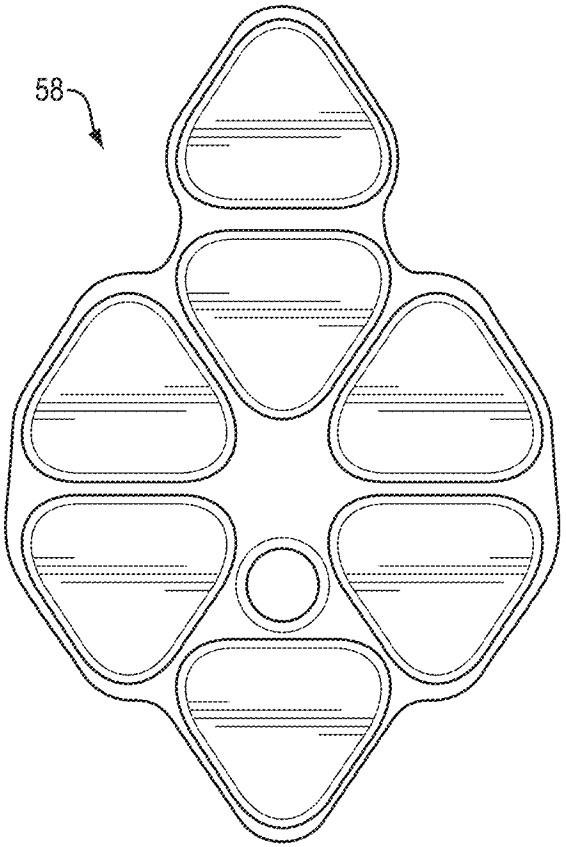
FIG. 16A is a top view (the side facing the wearer) of a helmet crown liner according to a non-limiting aspect of the subject technology.
Figure 18B:
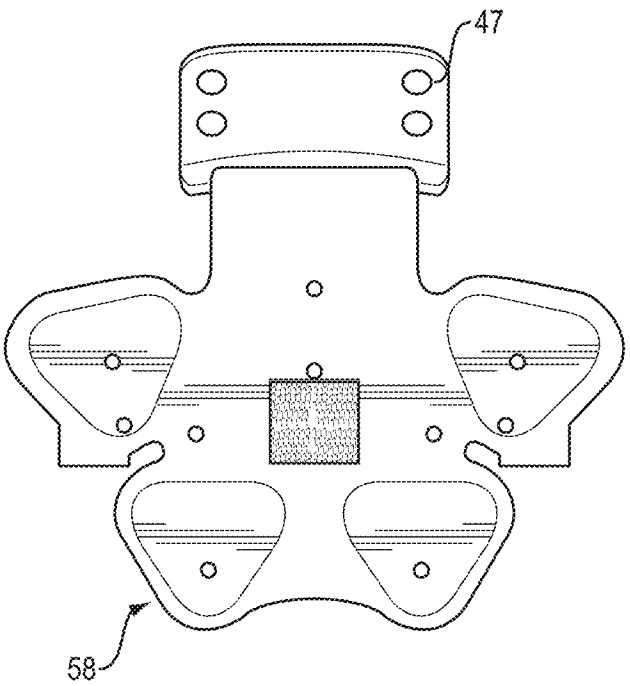
FIG. 18B is a bottom view of a helmet front liner according to a non-limiting aspect of the subject technology.
Figure 18A:
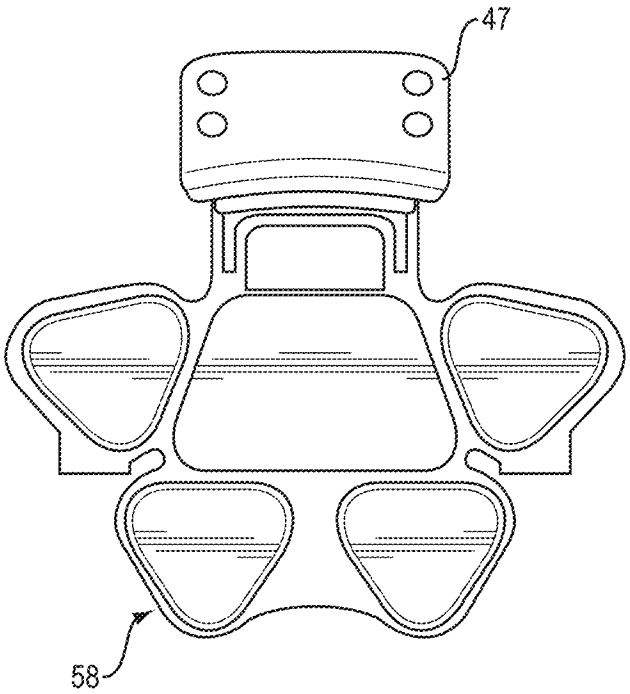
FIG. 18A is a top view (the side facing the wearer) of a helmet front liner according to a non-limiting aspect of the subject technology.
Figure 19B:
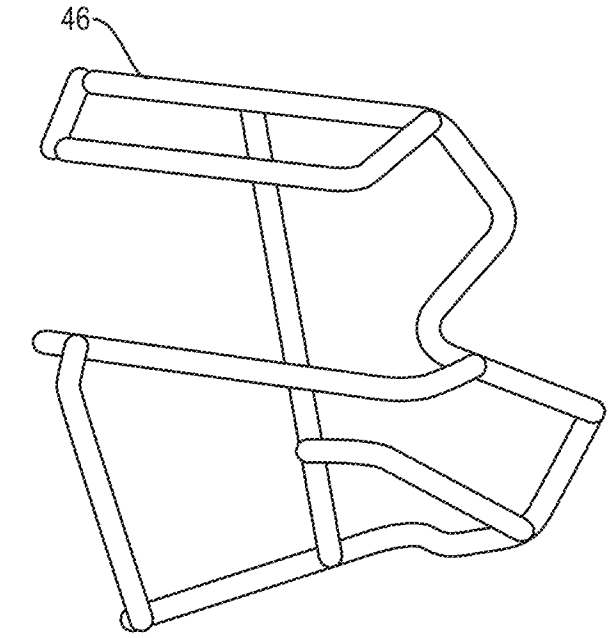
FIG. 19B is a left-side view of a face guard according to a non-limiting aspect of the subject technology.
Figure 19A:
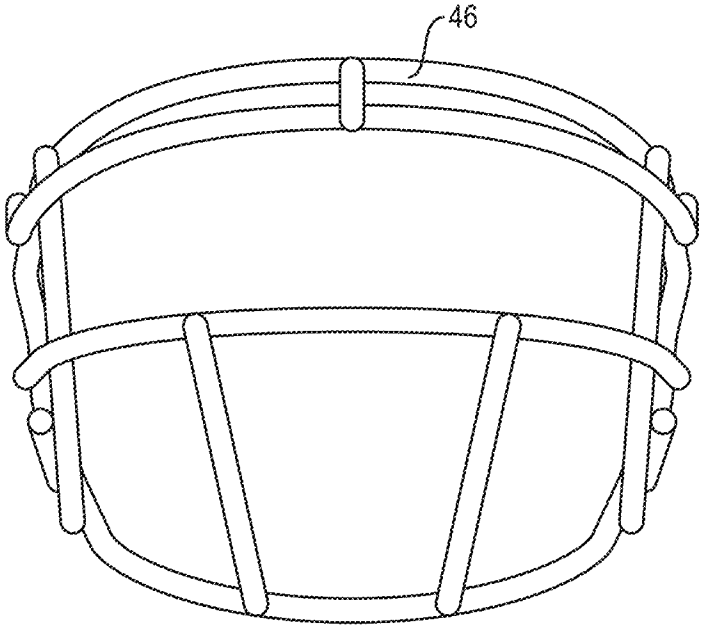
FIG. 19A is a front view of a face guard according to a non-limiting aspect of the subject technology.

In the non-limiting embodiment of FIG. 6, for example, a lateral liner 50 for a football helmet has a top sheet 51 of TPU material bonded to a bottom sheet 52 of TPU material. Lateral liner 50 is adapted to be disposed in the rear and side areas of the inside of a helmet. Pockets 54 (only one is numbered) are formed in the top sheet, to form cells 55 (only one is numbered) distributed over the area of the top sheet 51 facing the wearer. All of the cells 55 contain pads 53 (only one is numbered) of PORON® foam, which mostly or substantially entirely fill cells 55. In this non-limiting embodiment, cells 55 are optionally not connected by passages, and there is no valve provided to inflate cells 55 with air. Cells 55 may be vented to the atmosphere through small vent holes 56 (only one is numbered) formed in bottom sheet 52. The liner 50 is sized and shaped to be positioned to cover the back and side of the wearer's head, but a liner according to a non-limiting aspect of the subject technology could be sized and shaped to be disposed in the crown area of the helmet (as for examples in FIGS. 16A and 16B) or the front area (as in FIGS. 18A and 18B). The applicants have achieved exceptional performance in a football helmet comprising a plurality of inner liners, in which all of the liners have cells filled with PORON® foam, and no valve or other means to inflate the cells is provided (i.e., the helmet does not have "air liners").

Non-limiting commercial embodiments of aspects of the subject technology by the assignee of the present application d/b/a Schutt Sports include the Schutt F7 VTD, Schutt F7 LTD, and Schutt F7 UR1 football helmets. These helmets are variants of the Schutt F7 football helmet, which is substantially as described in co-pending U.S. patent application Ser. No. 15/855,876 (the "'876 application"), published as U.S. Published Patent Application No. 2018/0343953. The unmodified Schutt F7 helmet, the Schutt F7 VTD helmet, Schutt F7 LTD helmet are all NOCSAE-certified and are commercially available products of Schutt Sports. The Schutt F7 UR1 helmet is a forthcoming product.

In the Schutt F7 VTD helmet, the front pad assembly 153 (of the '876 application) is replaced by the dual-stiffness, single-durometer pad of FIGS. 2A-2D herein, enclosed in a liner as in FIGS. 3A-3E with an inserted Poron pad. The weight of the tested F7 VTD helmet with face guard was 4.1 pounds.

Figure 13:
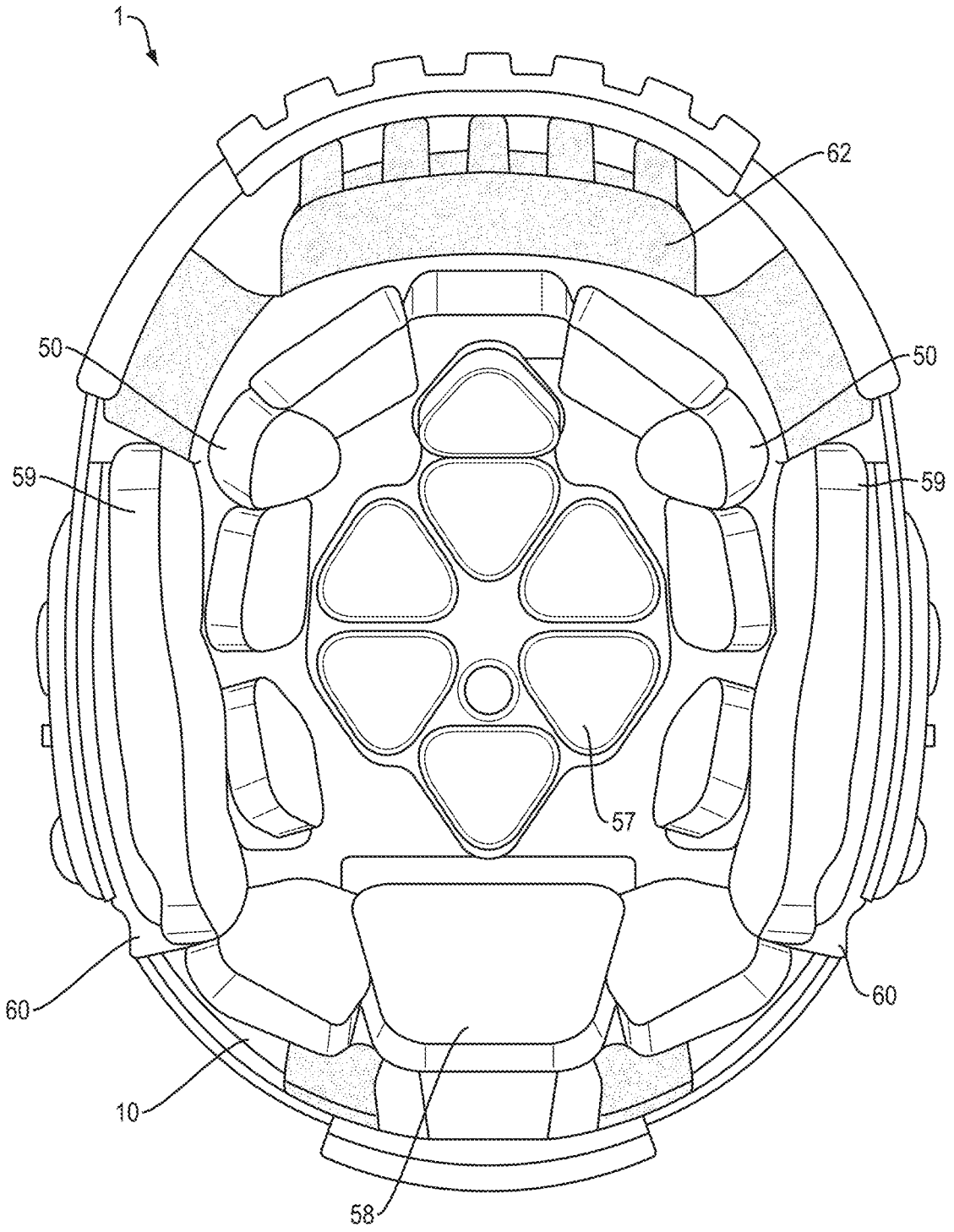
FIG. 13 is a bottom view of the interior of a football helmet according to a non-limiting aspect of the subject technology.
Figure 14:
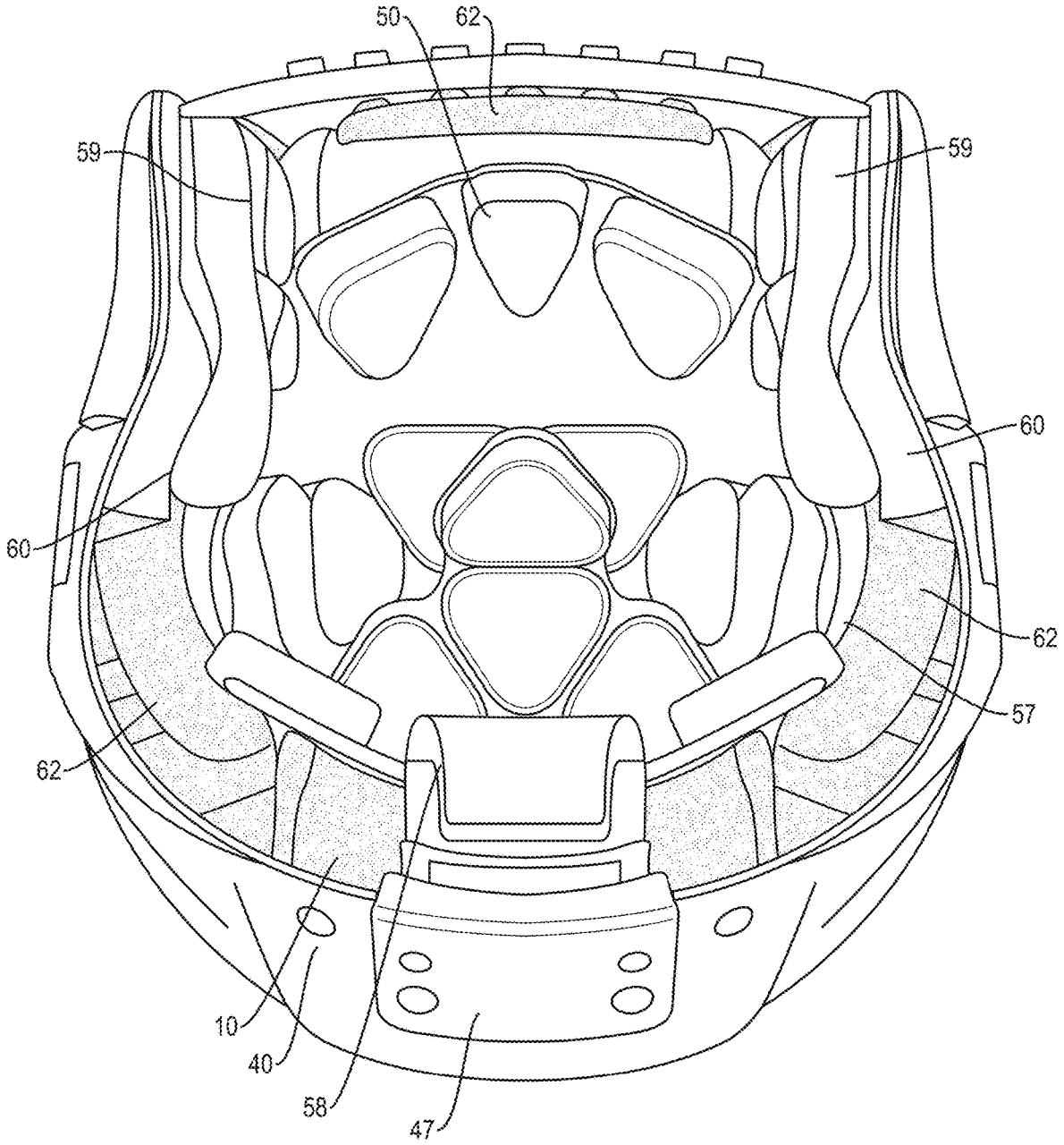
FIG. 14 is a front view into the interior of a football helmet according to a non-limiting aspect of the subject technology.
Figure 15:
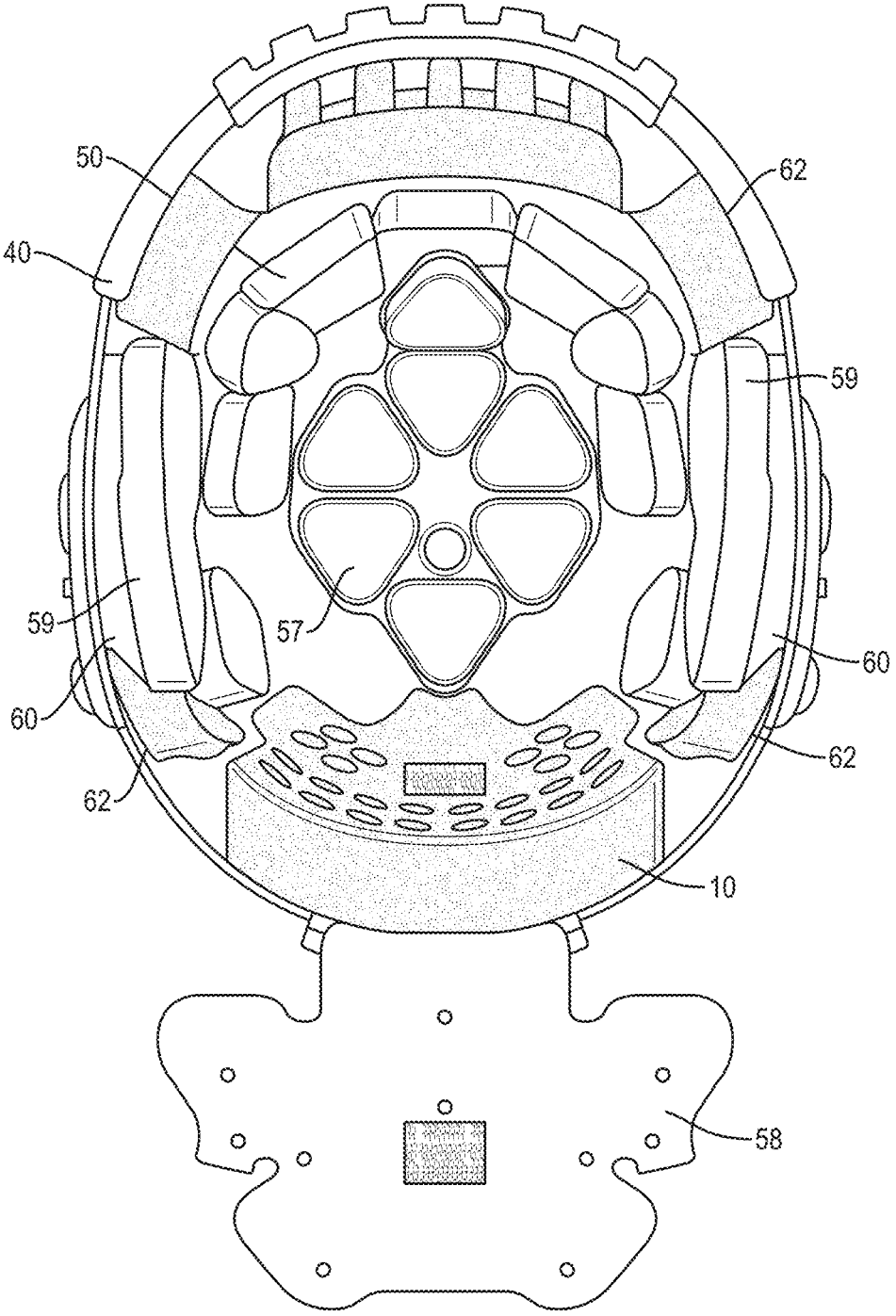
FIG. 15 is a bottom view of the interior of a football helmet according to a non-limiting aspect of the subject technology, with the front liner lifted out to show the front pad.
Figure 17:
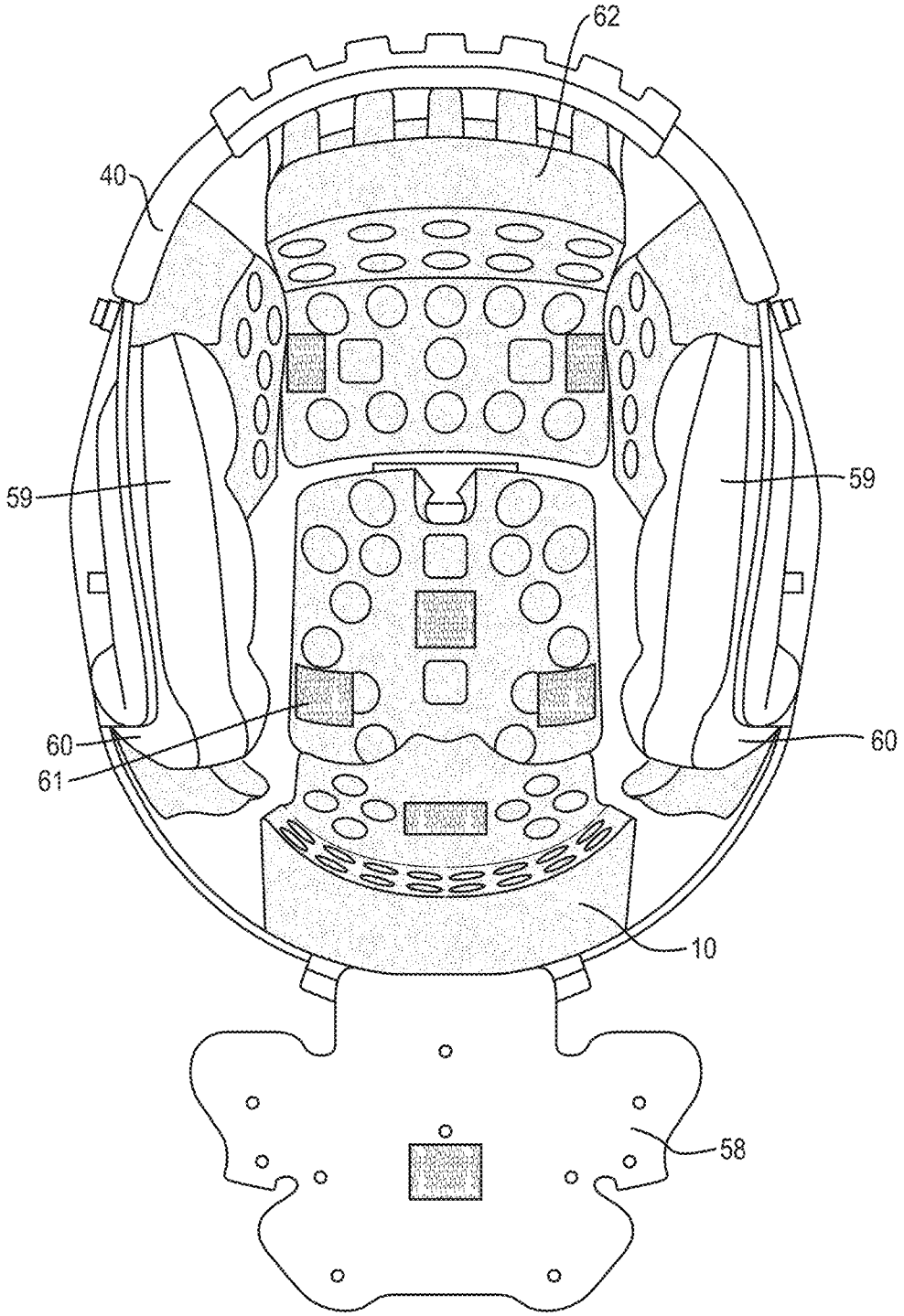
FIG. 17 is a view of the interior of a football helmet according to a non-limiting aspect of the subject technology, with the front liner lifted out to show the front pad, and the remainder of the liners removed to show the lateral and crown TPU shock absorbing pads.
Figure 20:
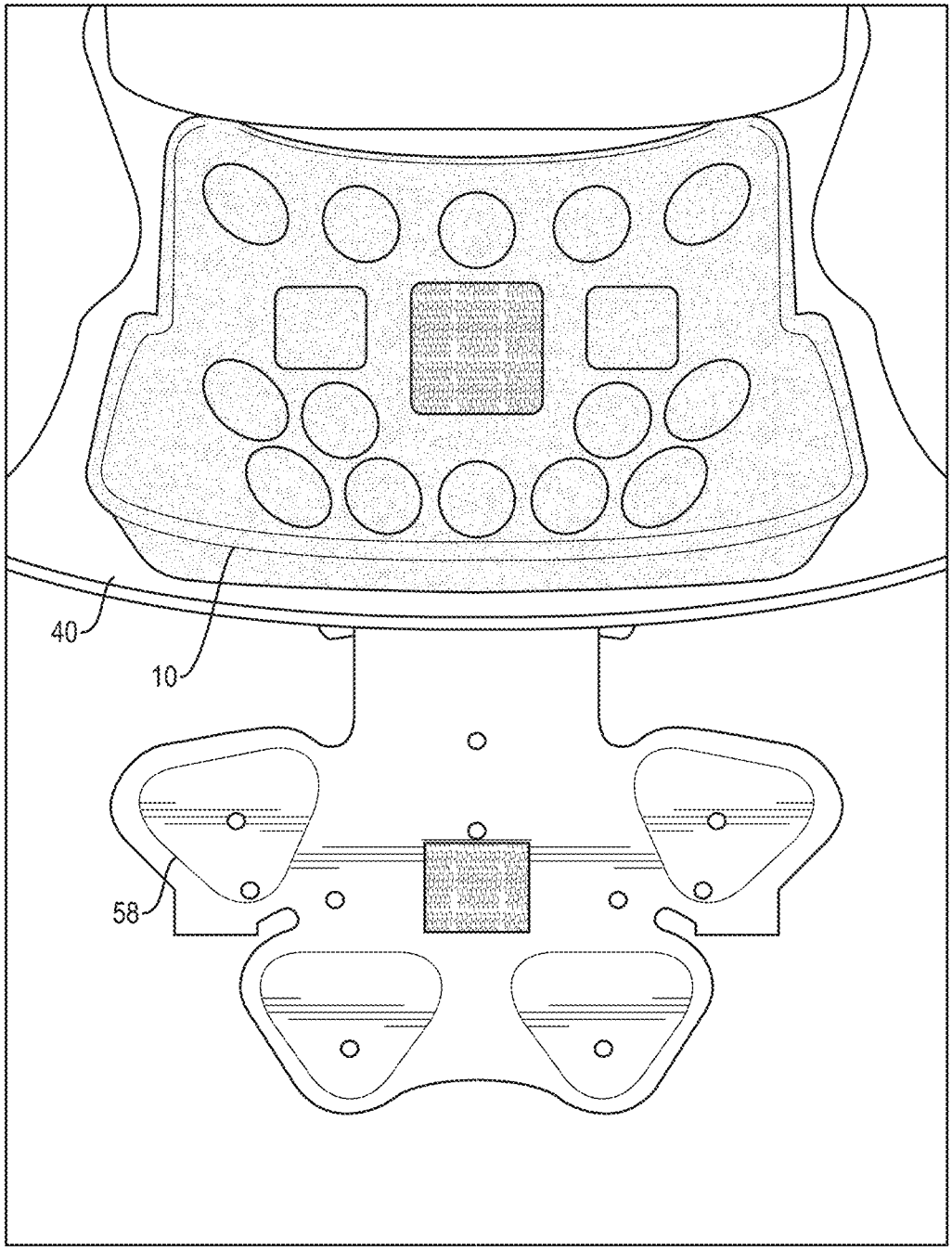
FIG. 20 is a view of the interior of a football helmet according to a non-limiting aspect of the subject technology, with the front liner lifted out to show the front pad.

The Schutt F7 LTD helmet, its parts and configuration are shown in FIGS. 1A-1D, 4-10, and 13-20, while other aspects of the F7 LTD helmet are unmodified with respect to the base F7 helmet described in the '876 application. The F7 LTD helmet has the following modifications with respect to the unmodified Schutt F7 helmet. The front pad assembly of the base F7 helmet (numbered 153 in the '876 application) is replaced by the dual-stiffness, dual-durometer pad 10 of FIGS. 1A-1D herein. The LTD liners are shown separately in FIGS. 6A-6D (the lateral liner 50), 16A-16B (crown liner 57) and 18A-18B (front liner 58). According to a non-limiting aspect of the subject technology, the cells of liners 50, 57, 58 in the LTD helmet contain PORON® pads, are not inflatable, and have exhaust holes for allowing air out of the cells. The liners are shown as installed in FIGS. 13-15. In FIG. 17, the liners and mobility layers (as shown and described in the '876 application) are removed to show the installed internal TPU shock absorbers (including crown TPU pad 61 and lateral TPU pad 62, as shown and described in the '876 application except for the front pad 10 which is according to subject technology). In FIGS. 15, 17 and 20 the front liner 58 is folded out of the helmet to show the dual-stiffness dual-durometer front pad 10 attached to the inner surface of the shell. The face guard 41 and its connection to the shell 40 are as shown in FIGS. 4, 5, 19A and 19B. The face guard 41 is attached to the shell 40 by loopstraps, T-nuts and screws as is known in the art; or optionally, by loopstraps with partial-turn faceguard mounting hardware substantially as disclosed in U.S. Pat. No. 8,819,871 for "Helmet with partial turn faceguard mounting," the entire disclosure of which is hereby incorporated by reference, which is assigned to the assignee of the present application. The shell 40 also has cheek supports 60 attached. The weight of the tested F7 LTD helmet with face guard was 5.1 pounds. (According to an aspect of the subject technology, the helmet with face guard has a weight of less than 5.5 pounds, or 5.1 pounds or less, or about 5 pounds.)

Figure 11:
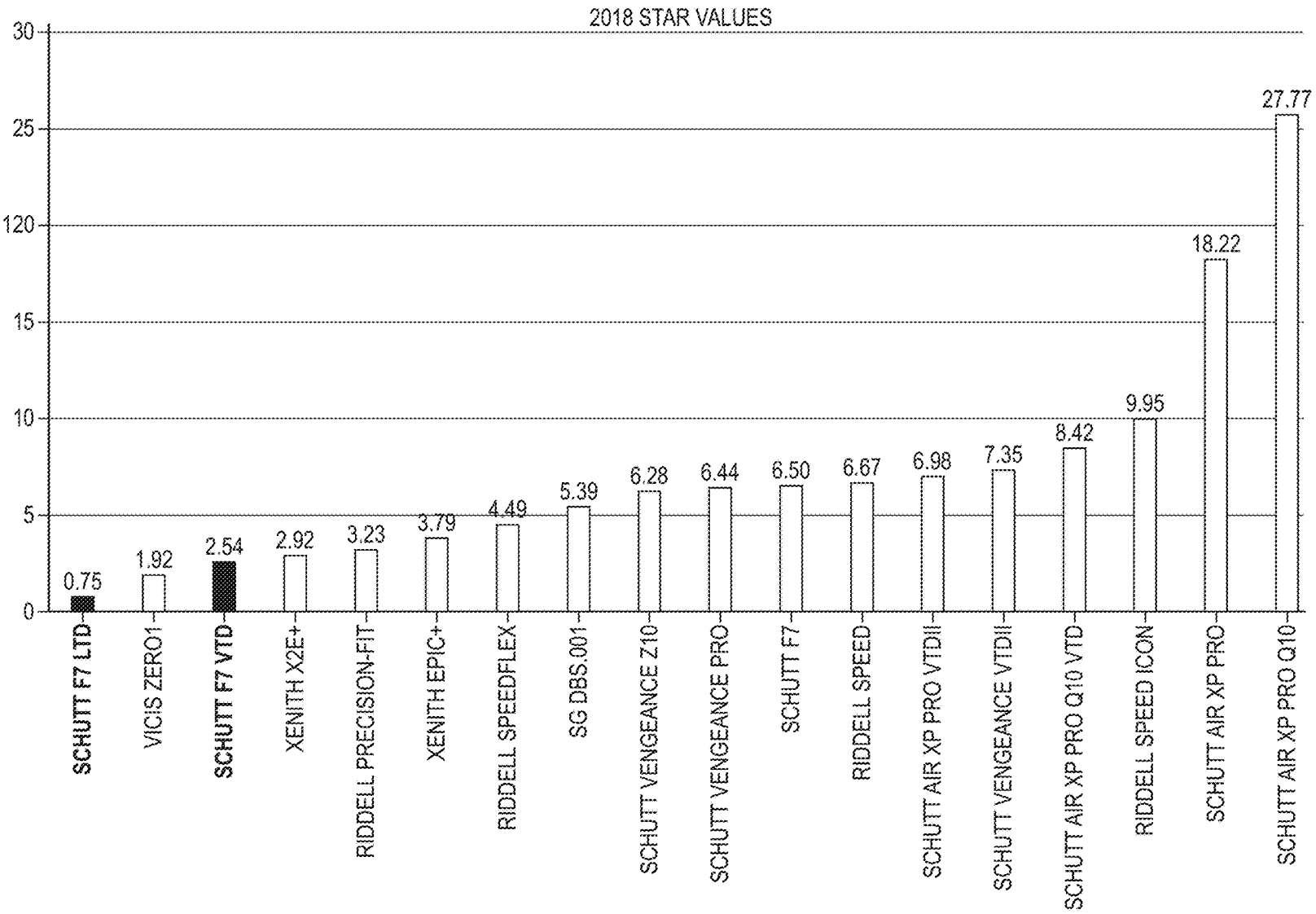
FIG. 11 is a bar graph of the results of the 2018 Virginia Tech Helmet Lab STAR ratings.

The published results of the 2018 Helmet Lab test are provided in Table 1 and are graphed for easy comparison in FIG. 11.

TABLE 1

| Helmet | STAR Value |
|---|---|
| Schutt F7 LTD | 0.75 |
| VICIS Zero1 | 1.92 |
| Schutt F7 VTD | 2.54 |

TABLE 1-continued

| Helmet | STAR Value |
|---|---|
| Xenith X2E+ | 2.92 |
| Riddell Precision-FIT | 3.23 |
| Xenith EPIC+ | 3.79 |
| Riddell SpeedFlex | 4.49 |
| SG DBS.001 | 5.39 |
| Schutt Vengeance Z10 | 6.28 |
| Schutt Vengeance Pro | 6.44 |
| Schutt F7 [unmodified] | 6.50 |
| Riddell Speed | 6.67 |
| Schutt Air XP Pro VTD II | 6.98 |
| Schutt Vengeance VTD II | 7.35 |
| Schutt Air XP Pro Q10 VTD | 8.42 |
| Riddell Speed Icon | 9.95 |
| Schutt Air XP Pro | 18.22 |
| Schutt Air XP Pro Q10 | 25.77 |

These test results show the surprising superiority of the subject technology over the prior art. The unmodified Schutt F7 helmet achieved a score of 6.50. The Schutt F7 VTD achieved a score of 2.54, ranking third in the test, and a substantial improvement over the unmodified Schutt F7. The Schutt F7 LTD achieved a score of 0.75, a vast improvement over both the unmodified Schutt F7 and the Schutt F7 VTD, and by far the best score of the 2018 Virginia Tech tests.

To put these results in perspective: a collegiate football player wearing the second-ranked helmet (having a score of 1.92) instead of the tested Schutt F7 LTD helmet (having a score of 0.75) during a season of play is reasonably expected to face more than 2.5 times the risk of concussion during the season, according to the science underlying the STAR Methodology. The subject technology is a quantum leap in impact absorption. However, it should be understood that head injuries are possible in football or any sport, even with the best available protection. The risk of injury to any specific individual depends on many factors, not only the qualities of the helmet worn by that individual. Better impact absorption has not been shown to be correlated with reduced risk of concussion.

It is within the scope of the subject technology to provide a somewhat stiffer response to impacts than in the Schutt F7 LTD, if desired for a particular application or playing position. This can be achieved in several ways. The internal padding system may be modified, for example, the stiffness of the front pad may be increased by using TPU material(s) of higher durometer(s), or a different (stiffer) configuration of TPU projections, as previously described. Alternatively, a conventional front pad could be used, which would result in stiffer response to a frontal shock. Additionally, attaching the face guard to the shell at higher attachment points that are near, at or above the median line may stiffen the helmet. These alterations would be expected to raise the Predictive Concussion Incidence of the helmet, such that a person of skill in the art could achieve a football helmet with higher Predictive Concussion Incidence than 0.75, as much as desired. Of course, the helmet must comply with NOCSAE Standards and be NOCSAE-certified to be suitable for use.

It will also be understood by those of skill in the art that a STAR Value or Predictive Concussion Index of less than 0.75 can be achieved by (relative to the Schutt F7 LTD helmet) placing the face guard attachment points even lower and/or further out on the helmet shell, and/or using a softer dual-stiffness front pad, and/or using a larger shell with more offset from the wearer's head, and/or using a thicker shell, and/or using thicker, stronger and/or heavier wire members in the face guard (for example, using a heavier carbon steel face guard instead of a lighter titanium face guard). Such modifications could be reasonably expected to achieve a STAR Value or Predictive Concussion Index of as low as 0.50 or lower.

The effect of variations in material and structure on Predictive Concussion Incidence are demonstrated, for example, by the following tests conducted by the assignee of the present application d/b/a Schutt. These tests were conducted on Schutt's apparatus, which is functionally equivalent to the Virginia Tech apparatus described in the STAR Methodology publication. The Schutt tests varied from the full STAR Methodology tests as noted below.

In a first series of tests, Schutt Sports conducted a comparative test of two helmets: Helmet 1, a Schutt F7 VTD helmet substantially as in the 2018 Virginia Tech test and Helmet 2, a Schutt F7 LTD helmet substantially as in the 2018 Virginia Tech test. The tests were conducted on Schutt's apparatus using a modified STAR Methodology. In this modified methodology, only the "front" and "front boss" locations were tested; and the impact velocities (3.49-3.57, 5.21-5.35, and 7.19-7.31 m/s for Helmet 1 and 3.73-3.78, 5.73-5.79, and 7.6-7.67 m/s for Helmet 2) used were slightly higher than in the STAR Methodology (3.0, 4.6, and 6.1 m/s). Tables 2A and 2B show the data for Helmet 1 and Helmet 2, respectively. Because only two locations were tested, an overall Predictive Concussion Incidence was not determined in this test. However, the partial Predictive Concussion Incidence of Helmet 1 vs. Helmet 2 due to the tested impacts at the "front" and "front boss" locations may be compared and are stated in Table 2. ("Partial Predictive Concussion Incidence" is used here because only two impact locations were tested.

The results are presented separately for each of the two locations.) Lower partial Predictive Concussion Incidence is better.

TABLE 2

| Helmet | Partial Predictive Concussion Incidence at "Front" Location | Partial Predictive Concussion Incidence at "Front Boss" Location | Total of "Front" and "Front Boss" Partial Predictive Concussion Incidence |
|---|---|---|---|
| Helmet 1 | 0.69 | 0.89 | 1.58 |
| Helmet 2 | 0.38 | 0.15 | 0.53 |

Comparing the partial Predictive Concussion Incidence of Helmet 1 to Helmet 2, these results show that use of the dual-durometer front pad and below-the-line faceguard hookup in Helmet 2 provide surprisingly improved performance over Helmet 1 with respect to impacts at "front" and "front boss" locations, which are especially of interest in a football helmet.

Figure 12:
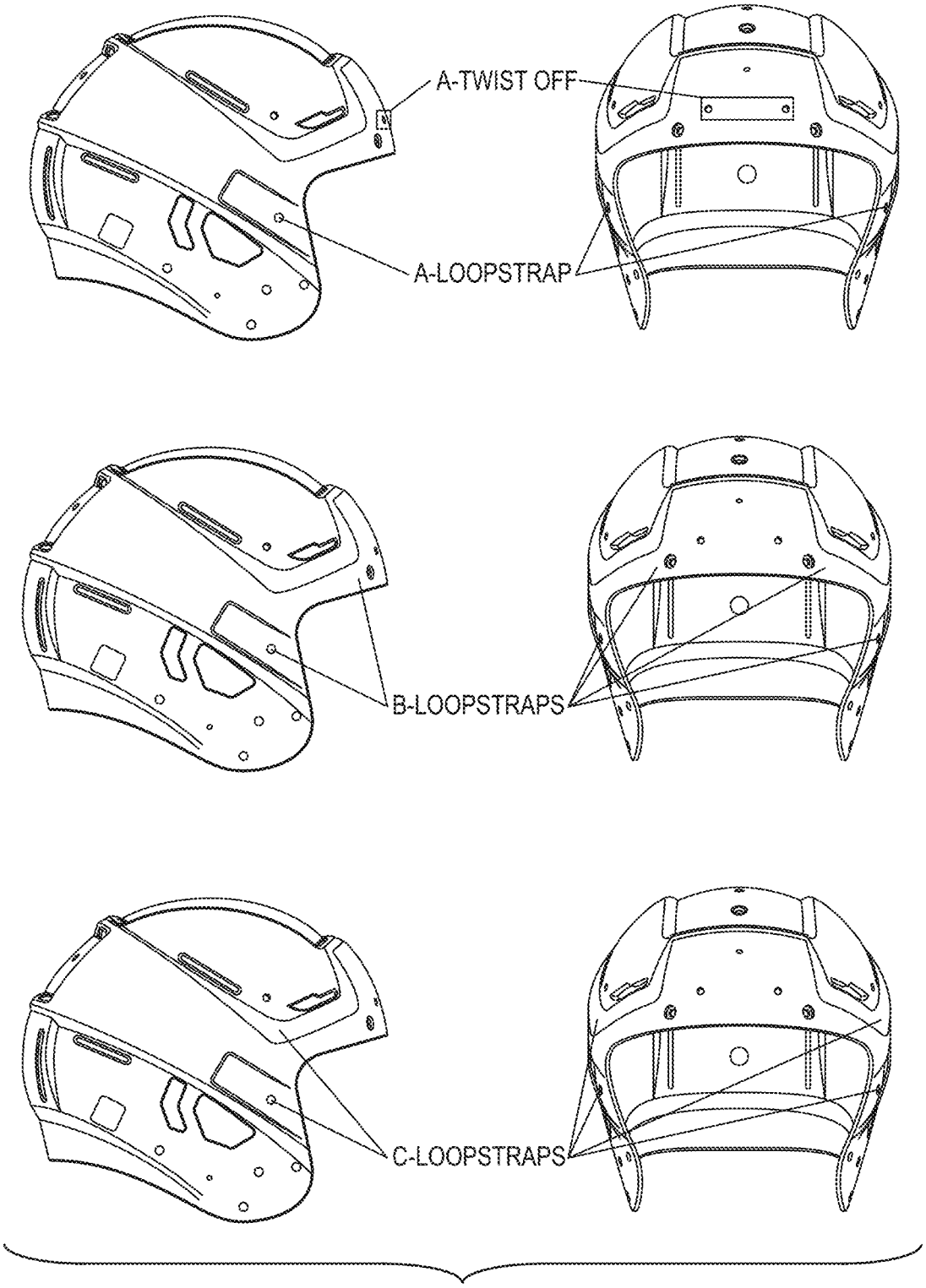
FIG. 12 is a series of side and front views of a football helmet shell showing alternative face guard attachment points.

In a second comparative test, Schutt tested a series of helmets having the Schutt F7 LTD shell of FIGS. 7-10 and various front pad and face guard attachment point configurations. Specifically, as stated in Table 3 below, certain helmets had the Schutt F7 VTD dual-stiffness single-durometer front pad within a liner as in FIG. 3; others had the Schutt F7 LTD dual-stiffness dual-durometer front pad within the liner (both as described above in connection with the Helmet Lab tests). Two different dual-durometer pads were tested (the difference being the durometers of the TPU materials used). The various face guard attachment points tested are shown in FIGS. 4, 5 and 12. The tests were conducted on Schutt's apparatus which is functionally equivalent to the Virginia Tech apparatus described in the STAR Methodology publication, using a modified STAR Methodology. In this modified methodology, only the "front" location was tested; additionally, the impact velocities used (3.75, 5.75, and 7.63 m/s) were slightly higher than in the STAR Methodology. Two samples of each helmet were tested at each impact velocity, as provided by the STAR Methodology. Because only one location was tested, an overall Predictive Concussion Incidence was not determined in this test. However, the partial Predictive Concussion Incidence of this series of helmets due to the tested impacts at the "front" locations may be compared and are stated in Table 3. ("Partial Predictive Concussion Incidence" is used here because only one impact location was tested.)

TABLE 3

| Helmet | Front Pad | Face Guard Attachment Points | "Front" Partial Predictive Concussion Incidence |
|---|---|---|---|
| Helmet A | Dual-stiffness, single-durometer | Central twist release and side mount loop straps, at points "A" shown in FIG. 12 | 0.74 |
| Helmet B | Dual-stiffness, single-durometer | Side mount loop straps only, at points "B" shown in FIG. 12 | 0.65 |
| Helmet C | Dual-stiffness, single-durometer | Side mount loop straps only, at points "C" as shown in FIG. 12 | 0.53 |
| Helmet D | Dual-stiffness, single-durometer | Side mount loop straps only, as in FIGS. 4 and 5 | 0.50 |
| Helmet E | Dual-stiffness, dual-durometer, Part A = 90 A, Part B = 85 A | Side mount loop straps only, as in FIGS. 4 and 5 | 0.52 |
| Helmet F | Dual-stiffness, dual-durometer, Part A = 95 A, Part B = 85 A | Side mount loop straps only, as in FIGS. 4 and 5 | 0.41 |

From the foregoing tests, it will be understood that selection of the face guard attachment points has a dramatic effect on partial Predictive Concussion Incidence (and, therefore, total Predictive Concussion Incidence) due to impact at, at least, the "front" impact location. Especially considering the progression from Helmet A (0.74) to Helmet D (0.50) as the attachment points are moved away from the Z-plane (i.e. away from the middle and toward the sides) and lower on the helmet shell, it is clear to one of skill in the art that a range of results are possible. Since a lower result is generally preferable, the attachment points of FIGS. 4 and 5 are preferred; however, other attachment points are within the scope of the subject technology and would result in a stiffer or less-stiff helmet as may be desired for a given application or playing position.

It will be understood that selecting the durometers of the dual-durometer front pad also has a dramatic effect on partial Predictive Concussion Incidence (and, therefore, total Predictive Concussion Incidence) due to impact at, at least, the "front" impact location. Especially considering the progression from Helmet E to Helmet F, it is clear to one of skill in the art that a range of results are possible. Since a lower result is generally preferable, the front pad of FIGS. 1A-1D having Part A=95A, Part B=85A is preferable; however, other selections of durometer are within the scope of the subject technology and would result in a stiffer or less-stiff helmet as may be desired for a given application or playing position.

From the foregoing disclosure and the appended Drawings, it will be understood that the subject technology includes a football helmet which has a Predictive Concussion Incidence of 0.75; or approximately 0.75; or 0.75 plus or minus 0.05; or 0.75 plus or minus 0.10; or 0.75 plus or minus 0.15; or 0.75 plus or minus 0.20; or 0.75 plus or minus 0.25. Preferably the football helmet meets NOCSAE Standards and/or is NOCSAE-certified. Preferably the helmet with face guard has a weight of less than 5.5 pounds, or 5.1 pounds or less, or about 5 pounds or less.

Additionally, the subject technology includes a football helmet which has a Predictive Concussion Incidence of less than 0.75; or less than 0.80; or less than 0.85; or less than 0.90; or less than 0.95; or less than 1.0; or less than 1.1; or less than 1.2; or less than 1.3; or less than 1.4; or less than 1.5; or less than 1.6; or less than 1.7; or less than 1.8; or less than 1.9. Preferably the football helmet meets NOCSAE Standards and/or is NOCSAE-certified. Preferably the helmet with face guard has a weight of less than 5.5 pounds, or 5.1 pounds or less, or about 5 pounds or less.

From the foregoing, it will be understood that the subject technology includes a football helmet which has a Predictive Concussion Incidence in the range of 0.75 to 0.80; or 0.75 to 0.85; or 0.75 to 0.90; or 0.75 to 0.95; or 0.75 to 1.00; or 0.75 to 1.05; or 0.75 to 1.10; or 0.75 to 1.15; or 0.75 to 1.25; or 0.75 to 1.30; or 0.75 to 1.35; or 0.75 to 1.40; or 0.75 to 1.45; or 0.75 to 1.50; or 0.75 to 1.55; or 0.75 to 1.60; or 0.75 to 1.65; or 0.75 to 1.70; or 0.75 to 1.75; or 0.75 to 1.80; or 0.75 to 1.85; or 0.75 to 1.90. Preferably the football helmet meets NOCSAE Standards and/or is NOCSAE-certified. Preferably the helmet with face guard has a weight of less than 5.5 pounds, or 5.1 pounds or less, or about 5 pounds or less.

Additionally, the subject technology includes a football helmet which has a Predictive Concussion Incidence in the range of 0.70 to 0.80; or 0.70 to 0.85; or 0.70 to 0.90; or 0.70 to 0.95; or 0.70 to 1.00; or 0.75 to 1.05; or 0.70 to 1.10; or 0.70 to 1.15; or 0.70 to 1.25; or 0.70 to 1.30; or 0.70 to 1.35; or 0.70 to 1.40; or 0.70 to 1.45; or 0.70 to 1.50; or 0.70 to 1.55; or 0.70 to 1.60; or 0.70 to 1.65; or 0.70 to 1.70; or 0.70 to 1.75; or 0.70 to 1.80; or 0.70 to 1.85; or 0.70 to 1.90. Preferably the football helmet meets NOCSAE Standards and/or is NOCSAE-certified. Preferably the helmet with face guard has a weight of less than 5.5 pounds, or 5.1 pounds or less, or about 5 pounds or less.

Additionally, the subject technology includes a football helmet which has a Predictive Concussion Incidence in the range of 0.60 to 0.80; or 0.60 to 0.85; or 0.60 to 0.90; or 0.60 to 0.95; or 0.60 to 1.00; or 0.75 to 1.05; or 0.60 to 1.10; or 0.60 to 1.15; or 0.60 to 1.25; or 0.60 to 1.30; or 0.60 to 1.35; or 0.60 to 1.40; or 0.60 to 1.45; or 0.60 to 1.50; or 0.60 to 1.55; or 0.60 to 1.60; or 0.60 to 1.65; or 0.60 to 1.70; or 0.60 to 1.75; or 0.60 to 1.80; or 0.60 to 1.85; or 0.60 to 1.90. Preferably the football helmet meets NOCSAE Standards and/or is NOCSAE-certified. Preferably the helmet with face guard has a weight of less than 5.5 pounds, or 5.1 pounds or less, or about 5 pounds or less.

Additionally, the subject technology includes a football helmet which has a Predictive Concussion Incidence in the range of 0.50 to 0.80; or 0.50 to 0.85; or 0.50 to 0.90; or 0.50 to 0.95; or 0.50 to 1.00; or 0.75 to 1.05; or 0.50 to 1.10; or 0.50 to 1.15; or 0.50 to 1.25; or 0.50 to 1.30; or 0.50 to 1.35; or 0.50 to 1.40; or 0.50 to 1.45; or 0.50 to 1.50; or 0.50 to 1.55; or 0.50 to 1.60; or 0.50 to 1.65; or 0.50 to 1.70; or 0.50 to 1.75; or 0.50 to 1.80; or 0.50 to 1.85; or 0.50 to 1.90. Preferably the football helmet meets NOCSAE Standards and/or is NOCSAE-certified. Preferably the helmet with face guard has a weight of less than 5.5 pounds, or 5.1 pounds or less, or about 5 pounds or less.

Although the subject technology has outperformed the competition in comparative impact testing, scientists have not reached agreement on how the results of impact absorption tests relate to concussions. No conclusions about a reduction of risk or severity of concussive injury in any given instance should be drawn from impact absorption tests. No helmet system can prevent concussions or eliminate the risk of serious head or neck injuries while playing football.

While a specific embodiment of the subject technology has been shown and described in detail to illustrate the application of the principles of the subject technology, it will be understood that the subject technology may be embodied otherwise without departing from such principles. It will also be understood that the present subject technology includes any combination of the features and elements disclosed herein and any combination of equivalent features. The exemplary embodiments shown herein are presented for the purposes of illustration only and are not meant to limit the scope of the subject technology.

What is claimed is:

1. A football helmet comprising a plastic shell, internal padding attached to an inner surface of the shell, a face guard attached to the shell, the internal padding comprises a front pad made of solid polymer material and attached within the shell in a front area of the helmet above a face opening of the shell, the front pad defining a first zone of a first stiffness and, adjacent to and above the first zone, a second zone of a second stiffness lower than the first stiffness, the first zone disposed between a top edge of the face opening and the second zone, and wherein the football helmet has a Predictive Concussion Incidence of 0.75 plus or minus 0.25.

2. The football helmet of claim 1 wherein the face guard is attached to the shell at a plurality of attachment points, all of the plurality of attachment points below a line constructed through the midpoint of the height of the helmet as viewed from a left side of the helmet.

3. The football helmet of claim 2 wherein the plurality of attachment points comprise an upper left attachment point positioned forward of a lower left attachment point and an upper right attachment point positioned forward of a lower right attachment point.

4. The football helmet of claim 1 wherein the internal padding comprises a front pad attached within the shell in a front area of the helmet above a face opening of the shell, the front pad comprising a first solid polymer material having a first durometer and a second section above the first section comprising a second solid polymer material having a second durometer; wherein the first durometer is greater than the second durometer.

5. The football helmet of claim 4 wherein the first durometer is 90A plus or minus 3, or 95A plus or minus 3;

and the second durometer is 85A plus or minus 3; provided that the first durometer is greater than the second durometer.

6. The football helmet of claim 1 wherein the internal padding comprises a front pad attached within the shell in a front area of the helmet above a face opening of the shell, the front pad comprising a polymer sheet having integrally formed, tapering, hollow projections extending from the sheet in both the first section and the second section, the projections spaced apart from each other, the projections in the first section being made of a first polymer material having a first durometer, the projections in the second section being made of a second polymer material having a second durometer less than the first durometer.

7. The football helmet of claim 6 wherein the first durometer is 90A plus or minus 3, or 95A plus or minus 3; and the second durometer is 85A plus or minus 3; provided that the first durometer is greater than the second durometer.

8. The football helmet of claim 1 wherein the internal padding comprises one or more helmet liners wherein none of the helmet liners are air liners.

9. The football helmet of claim 1 provided that the football helmet is NOCSAE-certified, and the face guard is NOCSAE-certified.

10. A football helmet comprising a plastic shell, internal padding attached to an inner surface of the shell, a face guard attached to the shell, the internal padding comprises a front pad made of solid polymer material and attached within the shell in a front area of the helmet above a face opening of the shell, the front pad defining a first zone of a first stiffness and, adjacent to and above the first zone, a second zone of a second stiffness lower than the first stiffness, the first zone disposed between a top edge of the face opening and the second zone, and wherein the football helmet has a Predictive Concussion Incidence of less than 1.9, the football helmet is NOCSAE-certified, and the face guard is NOCSAE-certified.

11. A football helmet comprising a plastic shell, internal padding attached to an inner surface of the shell, a face guard attached to the shell, the internal padding comprises a front pad made of solid polymer material and attached within the shell in a front area of the helmet above a face opening of the shell, the front pad defining a first zone of a first stiffness and, adjacent to and above the first zone, a second zone of a second stiffness lower than the first stiffness, the first zone disposed between a top edge of the face opening and the second zone, and wherein the football helmet has a Predictive Concussion Incidence in the range of 0.50 to 1.90, the football helmet is NOCSAE-certified, and the face guard is NOCSAE-certified.

12. The football helmet of claim 10 and wherein the football helmet has a Predictive Concussion Incidence of less than 1.8.

13. The football helmet of claim 10 and wherein the football helmet has a Predictive Concussion Incidence of less than 1.7.

14. The football helmet of claim 10 and wherein the football helmet has a Predictive Concussion Incidence of less than 1.6.

15. The football helmet of claim 10 and wherein the football helmet has a Predictive Concussion Incidence of less than 1.5.

16. The football helmet of claim 10 and wherein the football helmet has a Predictive Concussion Incidence of less than 1.4.

17. The football helmet of claim 10 and wherein the football helmet has a Predictive Concussion Incidence of less than 1.3.

18. The football helmet of claim 10 and wherein the football helmet has a Predictive Concussion Incidence of less than 1.2.

19. The football helmet of claim 10 and wherein the football helmet has a Predictive Concussion Incidence of less than 1.1.

20. The football helmet of claim 10 and wherein the football helmet has a Predictive Concussion Incidence of less than 1.0.

21. The football helmet of claim 11 and wherein the football helmet has a Predictive Concussion Incidence in the range of 0.50 to 1.80.

22. The football helmet of claim 11 and wherein the football helmet has a Predictive Concussion Incidence in the range of 0.50 to 1.70.

23. The football helmet of claim 11 and wherein the football helmet has a Predictive Concussion Incidence in the range of 0.50 to 1.60.

24. The football helmet of claim 11 and wherein the football helmet has a Predictive Concussion Incidence in the range of 0.50 to 1.50.

25. The football helmet of claim 11 and wherein the football helmet has a Predictive Concussion Incidence in the range of 0.50 to 1.40.

26. The football helmet of claim 11 and wherein the football helmet has a Predictive Concussion Incidence in the range of 0.50 to 1.30.

27. The football helmet of claim 11 and wherein the football helmet has a Predictive Concussion Incidence in the range of 0.50 to 1.25.

28. The football helmet of claim 11 and wherein the football helmet has a Predictive Concussion Incidence in the range of 0.50 to 1.10.

29. The football helmet of claim 11 and wherein the football helmet has a Predictive Concussion Incidence in the range of 0.50 to 1.0.

* * * * *